US005922529A

United States Patent [19]

Tsuzuki et al.

[11] Patent Number: 5,922,529

[45] Date of Patent: Jul. 13, 1999

[54] PHOTOTHERMOGRAPHIC MATERIAL

[75] Inventors: Hirohiko Tsuzuki; Hisashi Okada; Yoshio Inagaki, all of Kanagawa, Japan

[73] Assignee: Fuji Photo Film Co., Ltd., Kanagawa, Japan

[21] Appl. No.: 08/996,914

[22] Filed: Dec. 23, 1997

[30] Foreign Application Priority Data

Dec. 26, 1996 [JP] Japan ..... 8-357348

[51] Int. Cl.[6] ..... G03C 1/498; G03C 1/08; G03C 1/34

[52] U.S. Cl. ..... 430/619; 430/584; 430/592; 430/600; 430/611; 430/613

[58] Field of Search ..... 430/619, 510, 430/584, 577, 613, 517, 600, 611, 513, 592

[56] References Cited

U.S. PATENT DOCUMENTS 5,441,886 8/1995 Miller et al. .

5,491,057 2/1996 Hioki ..... 430/584

FOREIGN PATENT DOCUMENTS 0559228 9/1993 European Pat. Off. .

58-189628 11/1983 Japan .

4 182639 6/1992 Japan .

*Primary Examiner*—Thorl Chea

*Attorney, Agent, or Firm*—Birch, Stewart, Kolasch & Birch, LLP

[57] ABSTRACT

A photothermographic material has a photosensitive layer containing a binder, organic silver salt, reducing agent, and silver halide on one surface of a support. The photosensitive layer further contains a specific sulfur-containing compound and a merocyanine dye of specific structure and has an absorbance of 0.15–1.0 at an exposure wavelength. Sharpness, sensitivity, and aging stability are improved.

11 Claims, No Drawings

PHOTOTHERMOGRAPHIC MATERIAL

This invention relates to a photothermographic material.

BACKGROUND OF THE INVENTION

From the contemporary standpoints of environmental protection and space saving, it is strongly desired in the medical imaging field to reduce the quantity of spent solution. Needed in this regard is a technology relating to thermographic photosensitive materials for use in medical diagnosis and general photography which can be effectively exposed by means of laser image setters and laser imagers and produce distinct black images having high resolution and sharpness. These thermographic photosensitive materials offer to the customer a simple thermographic system which eliminates a need for solution type chemical agents and is not detrimental to the environment.

On the other hand, the laser technology is now on rapid progress and applied to medical image output devices. For example, the sensitizing technique is disclosed in U.S. Pat. No. 5,441,866 and the anti-fogging technique disclosed in JP-A 182639/1992.

Photothermographic materials are generally highly transparent and require addition of anti-irradiation dyes in order to maintain sharpness. The anti-irradiation dyes, however, tend to prohibit the adsorption of sensitizing dyes to silver halide, leaving the problem that the photo-sensitive material experiences a significant drop of sensitivity during long-term storage.

SUMMARY OF THE INVENTION

An object of the invention is to provide a novel and improved photothermographic material having improved sharpness, sensitivity and shelf stability.

According to the invention, there is provided a photothermographic material comprising a binder, an organic silver salt, a reducing agent for silver ion, and photosensitive silver halide grains on at least one surface of a support. A photosensitive layer containing the photo-sensitive silver halide grains further contains a compound of the general formula (I) and a compound of the general formula (II). The photosensitive layer has an absorbance of 0.15 to 1.0 at an exposure wavelength.

$$R—S(M)_n \qquad (I)$$

R is an aliphatic hydrocarbon, aryl or heterocyclic group, preferably a nitrogenous heterocyclic group, M is a hydrogen atom or cation, and letter n is a number determined so as to render the molecule neutral.

(II)

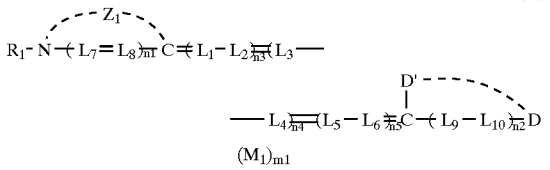

$Z_1$ is a group of atoms necessary to form a 5- or 6-membered nitrogenous heterocycle, each of D and D' is a group of atoms necessary to form an acyclic or cyclic acidic nucleus, $R_1$ is an alkyl group, $L_1$, $L_2$, $L_3$, $L_4$, $L_5$, $L_6$, $L_7$, $L_8$, $L_9$, and $L_{10}$ each are a methine group, which may form a ring with another methine group or a ring with an auxochrome, letters n1, n2, n3, n4, and n5 each are equal to 0 or 1, $M_1$ is an electric charge neutralizing counter ion, and letter m1 is an integer inclusive of 0 necessary to neutralize an electric charge in a molecule.

Preferably, the photosensitive layer contains 10 to 1,000 mol of the compound of formula (I) per mol of the compound of formula (II).

DETAILED DESCRIPTION OF THE INVENTION

The photothermographic material of the invention has a photosensitive layer on at least one surface of a support. The photosensitive layer contains photosensitive silver halide grains, a compound of the general formula (I) and a compound of the general formula (II), and has an absorbance of 0.15 to 1.0 at an exposure wavelength.

By using the compound of formula (II) as a sensitizing dye, combining the compound of formula (I) therewith, and restricting the absorbance of the photosensitive layer at an exposure wavelength to the range of 0.15 to 1.0, there is obtained a photothermographic material having low fog, high sensitivity, a minimal drop of sensitivity with time, and high sharpness.

In the absence of the compound of formula (I), the material shows an increased fog, a lower sensitivity, and a substantial drop of sensitivity with time. If a sensitizing dye other than the compound of formula (II) is used, the material shows a lower sensitivity and a substantial drop of sensitivity with time. Sharpness is lost with an absorbance of less than 0.15. An absorbance of more than 1.0 would increase the fog to make an image vague.

The advantages of the invention are obtained only when the compound of formula (I) and the sensitizing dye of formula (II) are used in combination and the absorbance of the photosensitive layer is restricted to the range of 0.15 to 1.0.

First, the compound of formula (I) is described in detail.

$$R—S(M)_n \qquad (I)$$

S stands for sulfur. R is an aliphatic hydrocarbon, aryl or heterocyclic group. The aliphatic hydrocarbon groups represented by R include normal, branched or cyclic alkyl groups, preferably having 1 to 30 carbon atoms, more preferably 1 to 22 carbon atoms, most preferably 1 to 20 carbon atoms, such as methyl, ethyl, isopropyl, tert-butyl, n-octyl, n-decyl, n-hexadecyl, octadecyl, cyclopropyl, cyclopentyl, and cyclohexyl; alkenyl groups, preferably having 2 to 30 carbon atoms, more preferably 2 to 20 carbon atoms, most preferably 2 to 16 carbon atoms, such as vinyl, allyl, 2-butenyl, and 3-pentenyl; and alkynyl groups, preferably having 2 to 30 carbon atoms, more preferably 2 to 20 carbon atoms, most preferably 2 to 16 carbon atoms, such as propargyl and 3-pentynyl. They may be substituted ones. The preferred aliphatic hydrocarbon groups represented by R are alkyl groups.

The aryl groups represented by R may be monocyclic or form a fused ring, preferably a monocyclic or bicyclic aryl groups having 6 to 30 carbon atoms, more preferably 6 to 20 carbon atoms, most preferably 6 to 16 carbon atoms, such as phenyl and naphthyl. They may be substituted ones. The preferred aryl groups represented by R are phenyl and naphthyl, especially phenyl.

The heterocyclic groups represented by R are 3- to 10-membered saturated or unsaturated heterocyclic groups containing at least one element of nitrogen, oxygen and sulfur. They may be monocyclic or form a fused ring with another ring.

The heterocyclic groups are preferably 5- or 6-membered unsaturated heterocyclic groups, more preferably 5- or 6-membered aromatic heterocyclic groups. Further preferred are 5- or 6-membered aromatic heterocyclic groups containing a nitrogen atom, especially 5- or 6-membered aromatic heterocyclic groups containing 1 to 4 nitrogen atoms. Further preferably, they may have a fused ring or a substituent.

Illustrative, non-limiting examples of the heterocycle include pyrrolidine, piperidine, piperazine, morpholine, imidazoline, thiazoline, oxazoline, indoline, pyrazoline, thiophene, furan, pyrrole, imidazole, pyrazole, pyridine, pyrimidine, pyrazine, pyridazine, triazole, triazine, indole, indazole, purine, thiazole, thiadiazole, oxazole, oxadiazole, quinoline, phthalazine, naphthyridine, quinoxaline, quinazoline, cinnoline, pteridine, acridine, phenanthroline, phenazine, tetrazole, benzimidazole, benzoxazole, benzothiazole, benzoselenazole, indolenine, tetraazaindene, and perimidine. Preferred heterocycles are imidazole, pyrazole, pyridine, pyrimidine, pyrazine, pyridazine, triazole, triazine, indole, indazole, purine, thiazole, thiadiazole, oxazole, oxadiazole, quinoline, phthalazine, naphthyridine, quinoxaline, quinazoline, cinnoline, pteridine, acridine, phenanthroline, phenazine, tetrazole, benzimidazole, benzoxazole, benzothiazole, indolenine, tetraazaindene, and perimidine. More preferred heterocycles are pyridine, pyrimidine, pyrazine, pyridazine, triazole, triazine, thiadiazole, oxadiazole, quinoline, phthalazine, naphthyridine, quinoxaline, quinazoline, cinnoline, tetrazole, benzimidazole, benzoxazole, benzothiazole, and tetraazaindene. Further preferred heterocycles are triazole, thiazole, thiadiazole, oxazole, oxadiazole, tetrazole, benzimidazole, benzoxazole, and benzothiazole. Still further preferred heterocycles are benzimidazole, benzoxazole, and benzothiazole. Benzimidazole is most preferred.

Substituents on the aliphatic hydrocarbon, aryl, and heterocyclic group represented by R include alkyl groups, preferably having 1 to 20 carbon atoms, more preferably 1 to 12 carbon atoms, most preferably 1 to 8 carbon atoms, such as methyl, ethyl, isopropyl, tert-butyl, hexyl, n-heptyl, n-octyl, n-decyl, n-hexadecyl, cyclopropyl, cyclopentyl, and cyclohexyl; alkenyl groups, preferably having 2 to 20 carbon atoms, more preferably 2 to 12 carbon atoms, most preferably 2 to 8 carbon atoms, such as vinyl, allyl, 2-butenyl, and 3-pentenyl; alkynyl groups, preferably having 2 to 20 carbon atoms, more preferably 2 to 12 carbon atoms, most preferably 2 to 8 carbon atoms, such as propargyl and 3-pentynyl; aryl groups, preferably having 6 to 30 carbon atoms, more preferably 6 to 20 carbon atoms, most preferably 6 to 12 carbon atoms, such as phenyl, p-methylphenyl, and naphthyl; amino groups, preferably having 0 to 20 carbon atoms, more preferably 0 to 10 carbon atoms, most preferably 0 to 6 carbon atoms, such as amino, methylamino, dimethylamino, diethylamino, and dibenzylamino; alkoxy groups, preferably having 1 to 20 carbon atoms, more preferably 1 to 12 carbon atoms, most preferably 1 to 8 carbon atoms, such as methoxy, ethoxy, and butoxy; aryloxy groups, preferably having 6 to 20 carbon atoms, more preferably 6 to 16 carbon atoms, most preferably 6 to 12 carbon atoms, such as phenyloxy and 2-naphthyloxy; acyl groups, preferably having 1 to 20 carbon atoms, more preferably 1 to 16 carbon atoms, most preferably 1 to 12 carbon atoms, such as acetyl, benzoyl, formyl, and pivaloyl; alkoxycarbonyl groups, preferably having 2 to 20 carbon atoms, more preferably 2 to 16 carbon atoms, most preferably 2 to 12 carbon atoms, such as methoxycarbonyl and ethoxycarbonyl; aryloxycarbonyl groups, preferably having 7 to 20 carbon atoms, more preferably 7 to 16 carbon atoms, most preferably 7 to 10 carbon atoms, such as phenyloxycarbonyl; acyloxy groups, preferably having 2 to 20 carbon atoms, more preferably 2 to 16 carbon atoms, most preferably 2 to 10 carbon atoms, such as acetoxy and benzoyloxy; acylamino groups, preferably having 2 to 20 carbon atoms, more preferably 2 to 16 carbon atoms, most preferably 2 to 10 carbon atoms, such as acetylamino, hexanoylamino, octanoylamino, and benzoylamino; alkoxycarbonylamino groups, preferably having 2 to 20 carbon atoms, more preferably 2 to 16 carbon atoms, most preferably 2 to 12 carbon atoms, such as methoxycarbonylamino; aryloxycarbonylamino groups, preferably having 7 to 20 carbon atoms, more preferably 7 to 16 carbon atoms, most preferably 7 to 12 carbon atoms, such as phenyloxycarbonylamino; sulfonylamino groups, preferably having 1 to 20 carbon atoms, more preferably 1 to 16 carbon atoms, most preferably 1 to 12 carbon atoms, such as methanesulfonylamino and benzenesulfonylamino; sulfamoyl groups, preferably having 0 to 20 carbon atoms, more preferably 0 to 16 carbon atoms, most preferably 0 to 12 carbon atoms, such as sulfamoyl, methylsulfamoyl, dimethylsulfamoyl, and phenylsulfamoyl; carbamoyl groups, preferably having 1 to 20 carbon atoms, more preferably 1 to 16 carbon atoms, most preferably 1 to 12 carbon atoms, such as carbamoyl, methylcarbamoyl, diethylcarbamoyl, heptylcarbamoyl, and phenylcarbamoyl; alkylthio groups, preferably having 1 to 20 carbon atoms, more preferably 1 to 16 carbon atoms, most preferably 1 to 12 carbon atoms, for example, methylthio and ethylthio; arylthio groups, preferably having 6 to 20 carbon atoms, more preferably 6 to 16 carbon atoms, most preferably 6 to 12 carbon atoms, for example, phenylthio; sulfonyl groups, preferably having 1 to 20 carbon atoms, more preferably 1 to 16 carbon atoms, most preferably 1 to 12 carbon atoms, for example, mesyl and tosyl; sulfinyl groups, preferably having 1 to 20 carbon atoms, more preferably 1 to 16 carbon atoms, most preferably 1 to 12 carbon atoms, for example, methanesulfinyl and benzenesulfinyl; ureido groups, preferably having 1 to 20 carbon atoms, more preferably 1 to 16 carbon atoms, most preferably 1 to 12 carbon atoms, for example, ureido, methylureido, and phenylureido; phosphoric amide groups, preferably having 1 to 20 carbon atoms, more preferably 1 to 16 carbon atoms, most preferably 1 to 12 carbon atoms, for example, diethylphosphoric amide and phenylphosphoric amide; hydroxy group; mercapto group; halogen atoms such as fluorine, chlorine, bromine and iodine atoms; cyano group; sulfo groups (inclusive of sulfonate groups); carboxyl group; nitro group; hydroxamic acid group; sulfino group; hydrazino group; and heterocyclic groups such as imidazolyl, pyridyl, furyl, thienyl, piperidyl, morpholino, and thiazolyl. These substituents may be further substituted. Where there are two or more substituents, they may be identical or different. Two or more substituents, taken together, may form a 5- to 7-membered carbon ring such as cyclopentane, cyclohexane, benzene, and cycloheptatriene.

Preferred substituents are alkyl, aryl, amino, alkoxy, aryloxy, alkylthio, arylthio, acyl, alkoxycarbonyl, aryloxycarbonyl, acyloxy, acylamino, alkoxycarbonylamino, aryloxycarbonylamino, sulfonylamino, sulfamoyl, carbamoyl, ureido, hydroxy, mercapto, halogen, sulfo (inclusive of sulfonate), carboxyl, nitro, cyano, and heterocyclic groups. More preferred are alkyl, aryl, alkoxycarbonyl, aryloxycarbonyl, acyloxy, acylamino, alkoxycarbonylamino, aryloxycarbonylamino, sulfonylamino, sulfamoyl, carbamoyl, ureido, halogen, and heterocyclic groups. Further preferred are alkyl, alkoxycarbonyl, aryloxycarbonyl, acyloxy, acylamino, alkoxycarbonylamino, aryloxycarbonylamino, sulfonylamino, sulfamoyl, carbamoyl, ureido, halogen, and heterocyclic groups. Most preferred are alkyl groups.

R is preferably a heterocyclic group, more preferably a 5- or 6-membered unsaturated heterocyclic group which may have a fused ring, further preferably a 5- or 6-membered aromatic heterocyclic group which may have a fused ring, most preferably a 5- or 6-membered aromatic heterocyclic group containing 1 to 4 nitrogen atoms which may have a fused ring.

M is a hydrogen atom or cation. The cation represented by M is an organic or inorganic cation, for example, alkali metal ions such as $Li^+$, $Na^+$, $K^+$, and $Cs^+$, alkaline earth metal ions such as $Mg^{2-}$ and $Ca^{2+}$, ammonium ions such as ammonium, trimethylammonium, triethylammonium, tetramethylammonium, tetraethylammonium, tetrabutylammonium, and 1,2-ethanediammonium, pyridinium ions, imidazolium ions, and phosphonium ions such as tetrabutylphosphonium. M is preferably a hydrogen atom or an alkali metal ion, more preferably a hydrogen atom.

Letter n is a number determined so as to render the molecule neutral. For example, where R is a monovalent cation, n is equal to 0. Where R is neutral and M is a monovalent cation, n is equal to 1.

The compounds of formula (I) may be a conjugated isomer thereof.

Among the compounds of formula (I), compounds of the following general formula (I-a) are preferred.

(I-a)

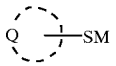

In formula (I-a), M is as defined in formula (I), with its preferred examples being the same. Q is a group of atoms necessary to form a nitrogenous aromatic heterocycle. Examples of the nitrogenous aromatic heterocycle represented by Q include pyrrole, imidazole, pyrazole, pyridine, pyrimidine, pyrazine, pyridazine, triazole, triazine, indole, indazole, purine, thiazole, thiadiazole, oxazole, oxadiazole, quinoline, phthalazine, naphthyridine, quinoxaline, quinazoline, cinnoline, pteridine, acridine, phenanthroline, phenazine, tetrazole, benzimidazole, benzoxazole, benzothiazole, benzoselenazole, tetraazaindene, and perimidine. Preferred heterocycles are imidazole, pyrazole, pyridine, pyrimidine, pyrazine, pyridazine, triazole, triazine, indole, indazole, purine, thiazole, thiadiazole, oxazole, oxadiazole, quinoline, phthalazine, naphthyridine, quinoxaline, quinazoline, cinnoline, pteridine, acridine, tetrazole, benzimidazole, benzoxazole, benzothiazole, benzoselenazole, and tetraazaindene. More preferred heterocycles are imidazole, triazole, thiazole, thiadiazole, oxazole, oxadiazole, tetrazole, benzimidazole, benzoxazole, and benzothiazole. Further preferred heterocycles are benzimidazole, benzoxazole, and benzothiazole. Benzimidazole is most preferred. The nitrogenous aromatic heterocycle represented by Q may have a substituent, examples of which are as exemplified for the substituent on R in formula (I).

Illustrative, non-limiting examples of the compound of formula (I) are given below.

I-1

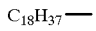

I-2

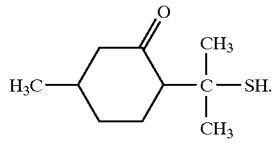

1-3

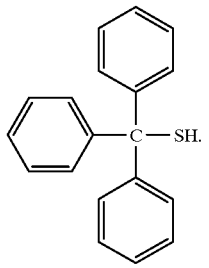

1-4

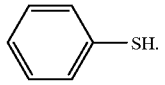

1-5

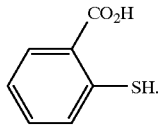

1-6

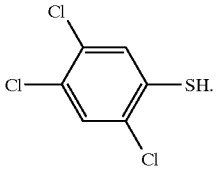

I-7

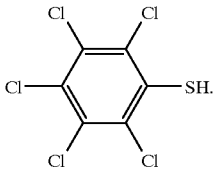

I-8

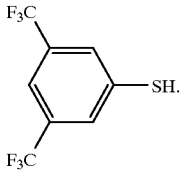

-continued
I-9
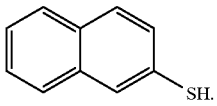
I-10
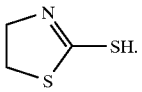
I-11
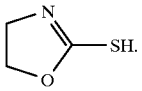
I-12
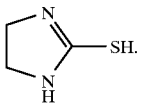
I-13
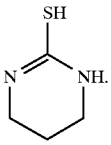
I-14
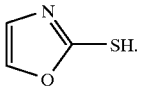
I-15
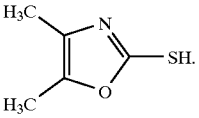
I-16
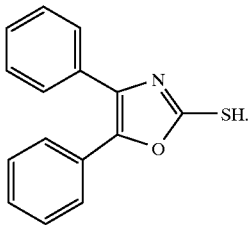
I-17
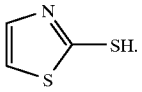
-continued
I-18
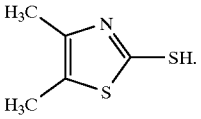
I-19
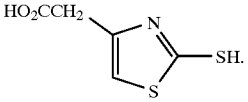
I-20
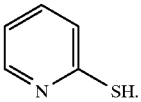
I-21
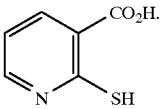
I-22
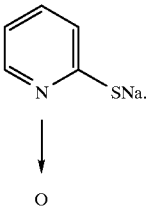
I-23
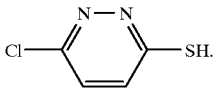
I-24
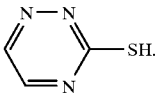
I-25
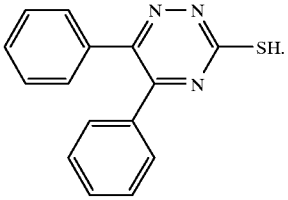
I-26
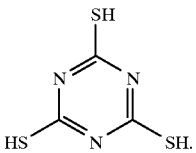

-continued
I-27
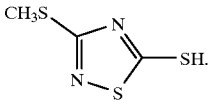
I-28
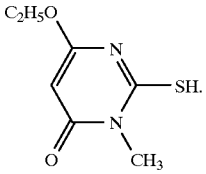
I-29
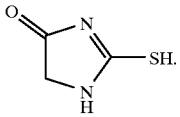
I-30
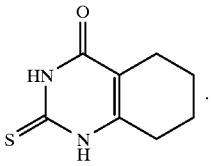
I-31
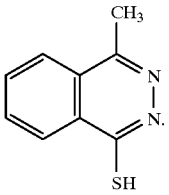
I-32
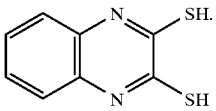
I-33
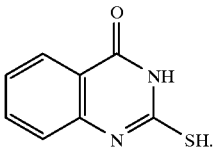
I-34
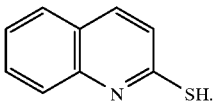
-continued
I-35
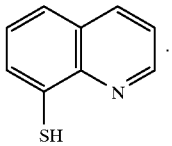
I-36
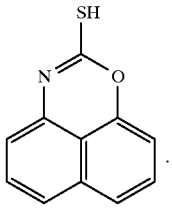
I-37
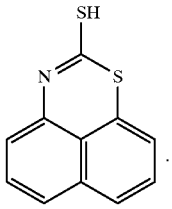
I-38
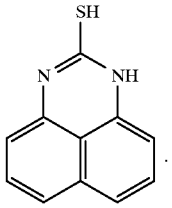
I-39
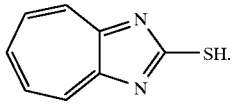
I-40
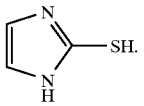
I-41
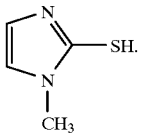

-continued
I-42
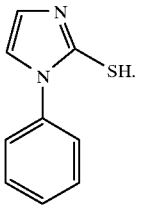
I-43
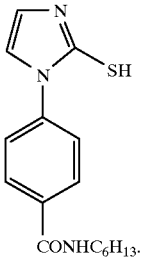
I-44
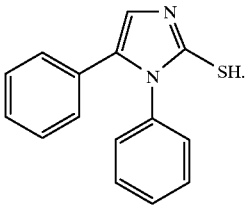
I-45
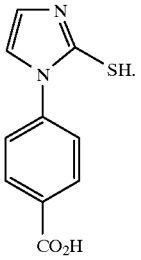
I-46
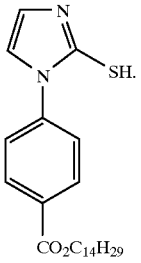
-continued
I-47
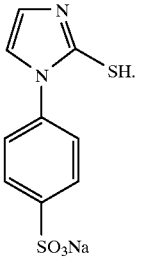
I-48
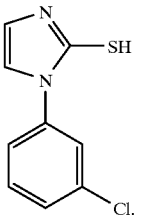
I-49
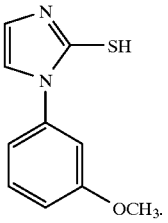
I-50
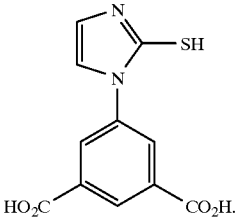
I-51
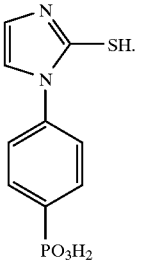

-continued
I-52
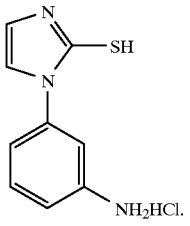
I-53
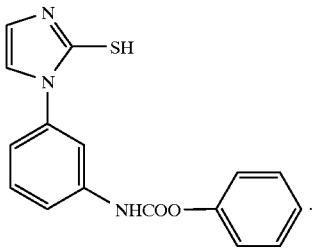
I-54
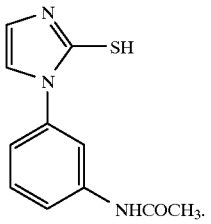
I-55
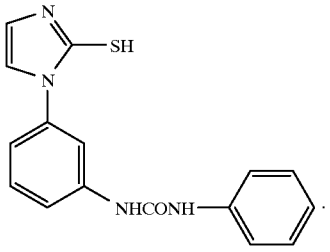
I-56
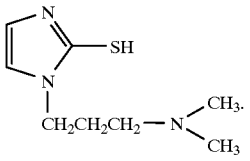
I-57
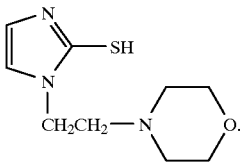
-continued
I-58
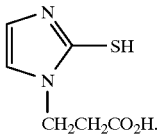
I-59
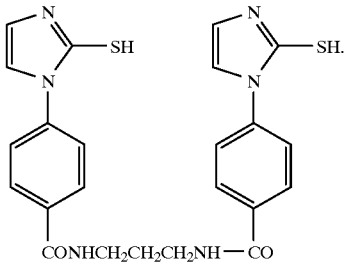
I-60
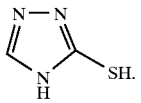
I-61
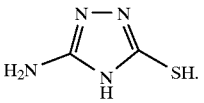
I-62
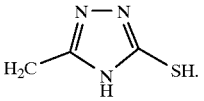
I-63
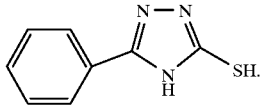
I-64
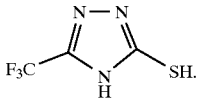
I-65
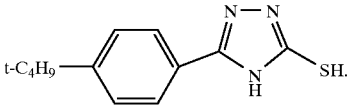
I-66
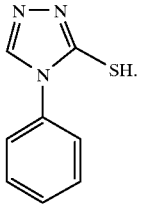

-continued
I-67
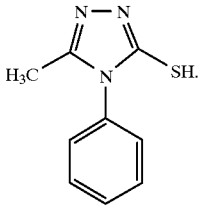
I-68
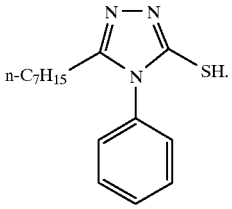
I-69
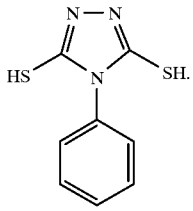
I-70
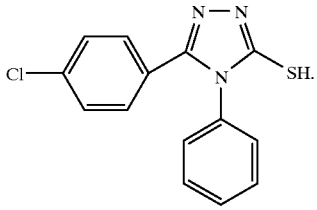
I-71
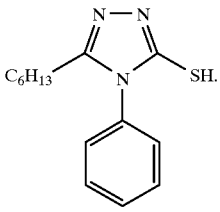
I-72
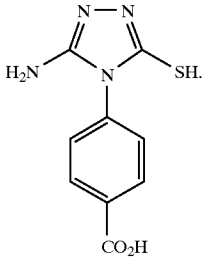
-continued
I-73
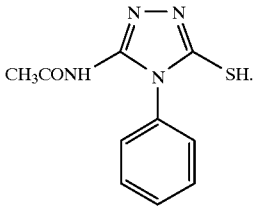
I-74
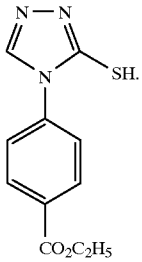
I-75
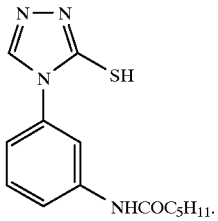
I-76
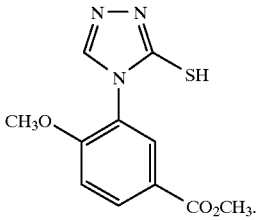
I-77
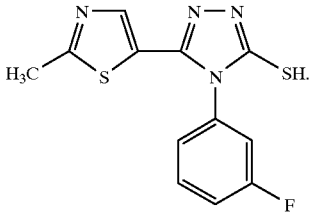
I-78
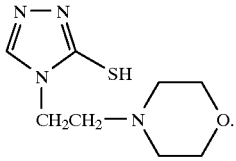

-continued
I-79
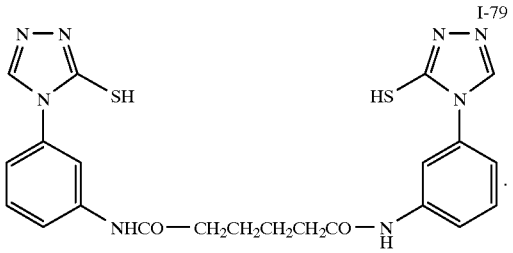
I-80
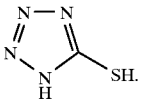
I-81
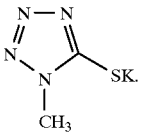
I-82
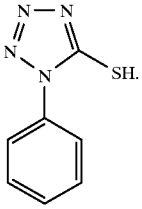
I-83
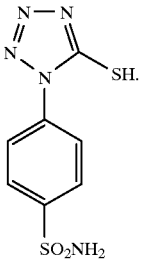
I-84
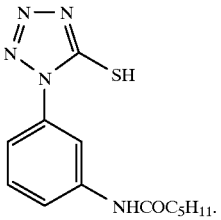
-continued
I-85
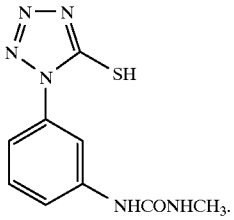
I-86
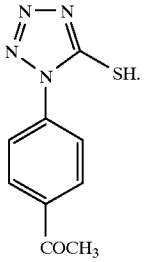
I-87
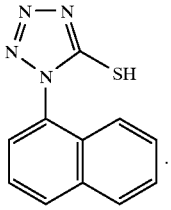
I-88
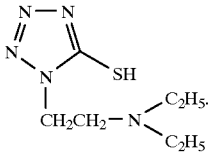
I-89
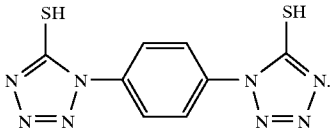
I-90
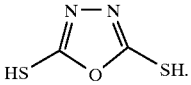
I-91
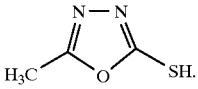
I-92
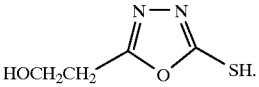

-continued
I-93
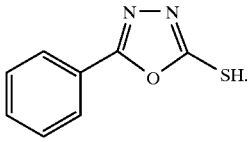
I-94
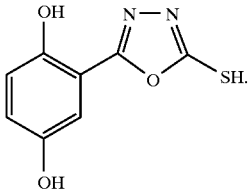
I-95
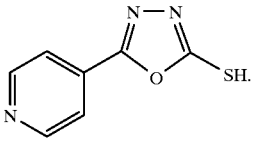
I-96
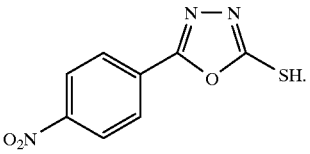
I-97
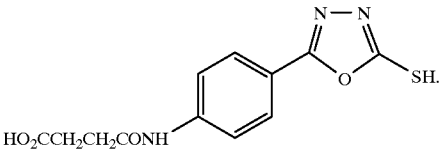
I-98
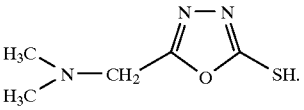
I-99
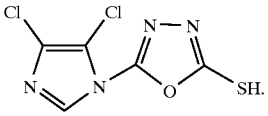
I-100
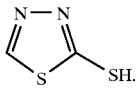
I-101
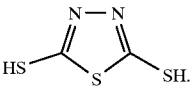
-continued
I-102
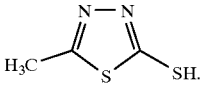
I-103
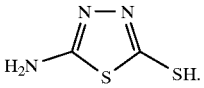
I-104
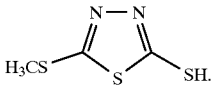
I-105
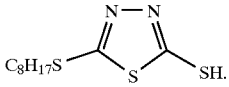
I-106
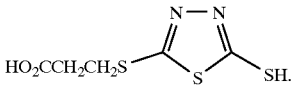
I-107
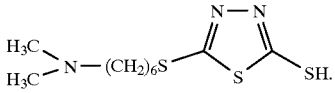
I-108
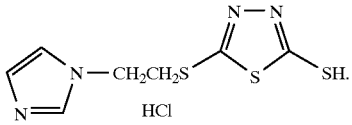
I-109
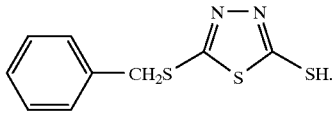
I-110
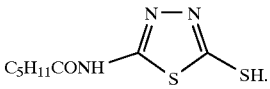
I-111
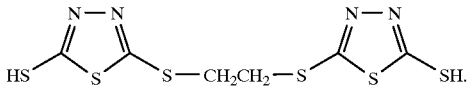
I-112
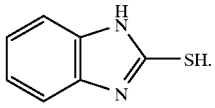

I-113
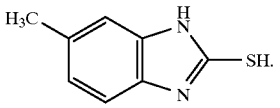
I-114
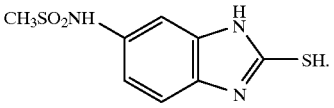
I-115
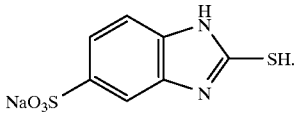
I-116
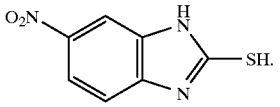
I-117
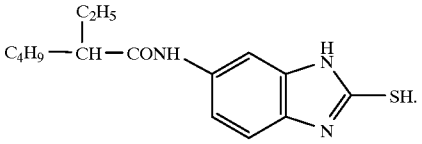
I-118
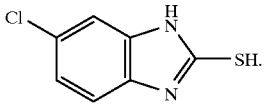
I-119
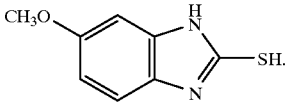
I-120
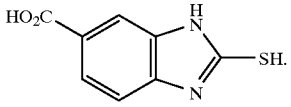
I-12
1
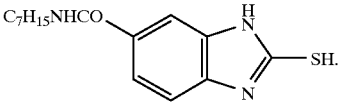
I-122
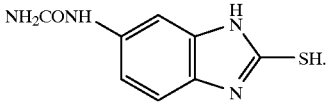
I-123
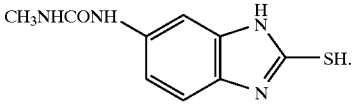
I-124
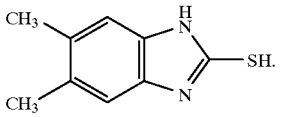
I-125
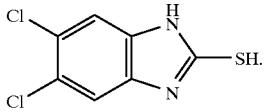
I-126
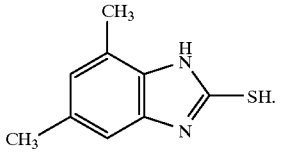
I-127
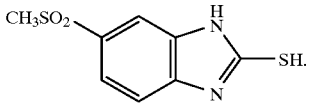
I-128
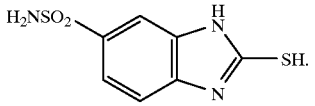
I-129
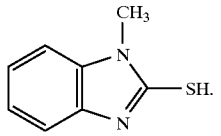
I-130
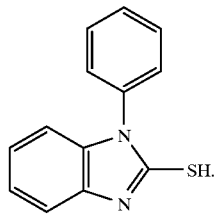

-continued
I-131
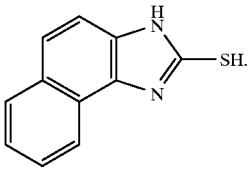
I-132
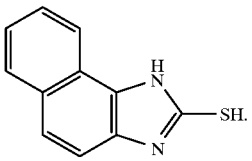
I-133
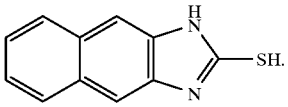
I-134
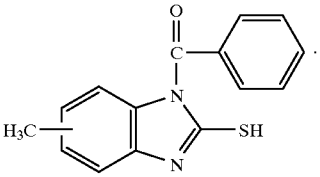
I-135
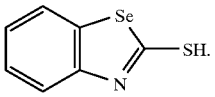
I-136
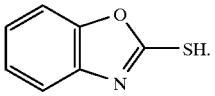
I-137
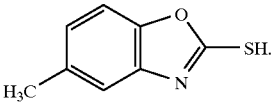
I-138
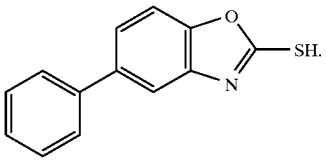
I-139
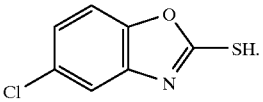
-continued
I-140
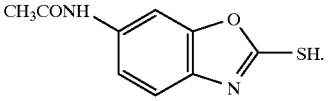
I-141
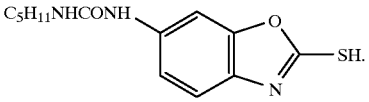
I-142
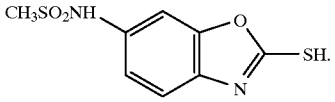
I-143
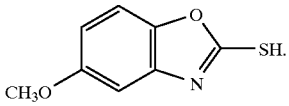
I-144
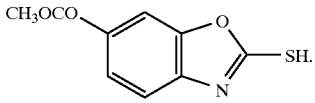
I-145
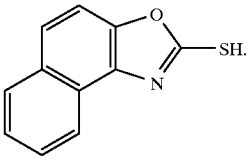
I-146
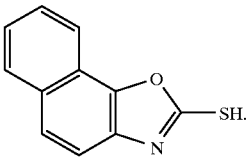
I-147
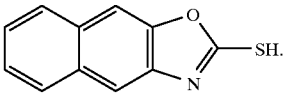
I-148
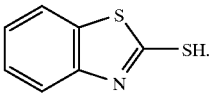
I-149
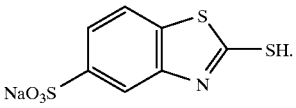

-continued
I-150
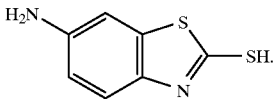
I-151
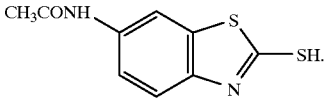
I-152
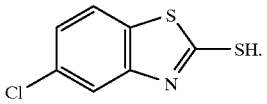
I-153
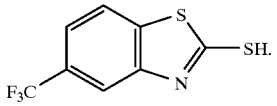
I-154
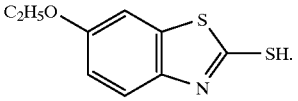
I-155
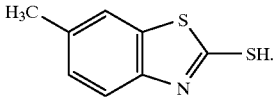
I-156
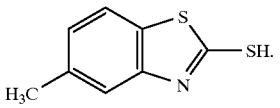
I-157
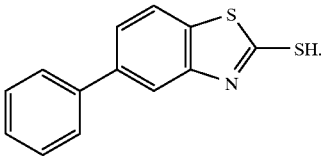
I-158
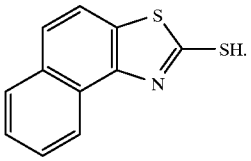
-continued
I-159
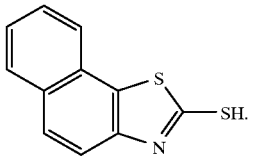
I-160
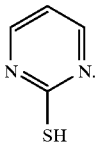
I-161
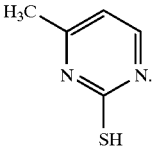
I-162
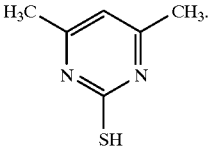
I-163
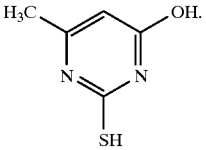
I-164
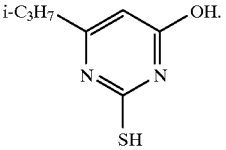
I-165
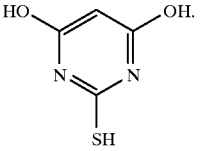
I-166
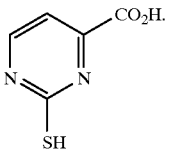

-continued
I-167
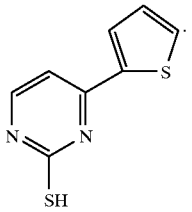
I-168
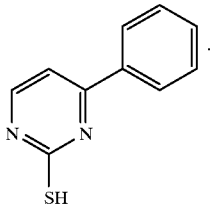
I-169
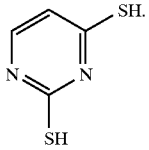
I-170
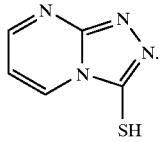
I-171
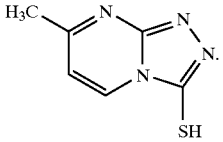
I-172
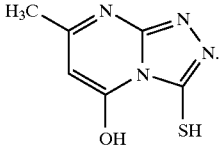
I-173
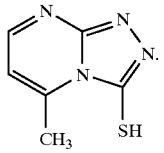
-continued
I-174
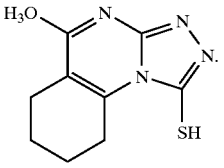
I-175
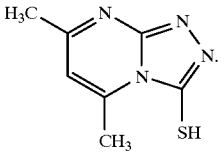
I-176
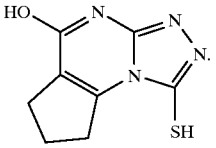
I-177
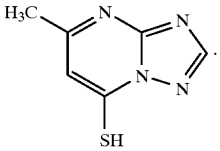
I-178
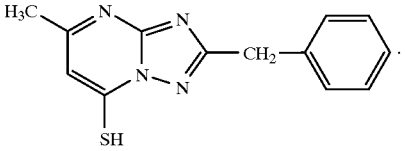
I-179
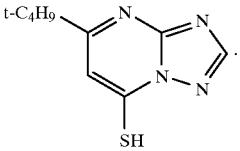
I-180
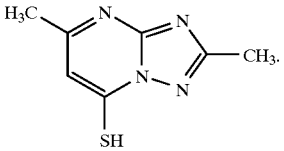
I-181
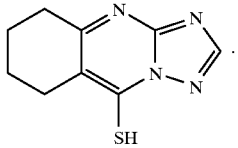

-continued
I-182
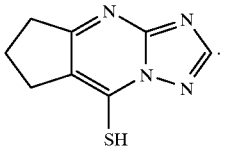
I-183
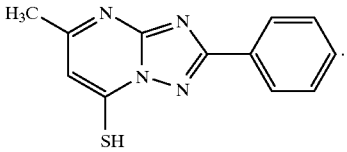
I-184
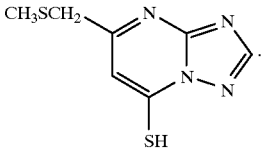
I-185
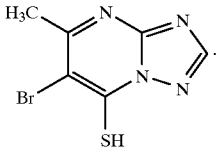
I-186
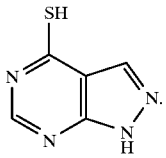
I-187
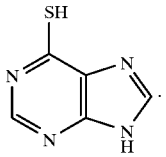
I-188
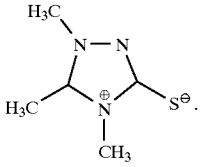
-continued
I-189
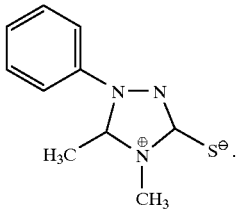
I-190
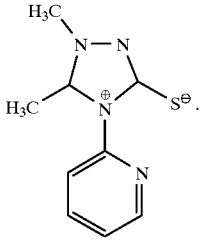
I-191
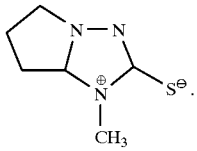
I-192
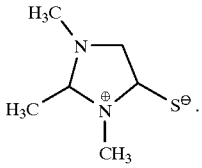
I-193
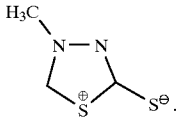
I-194
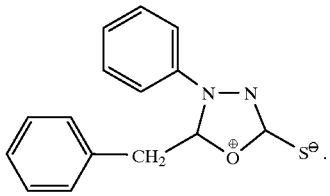
I-195
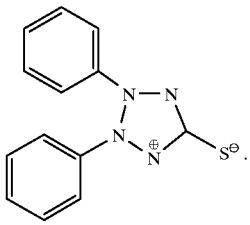

-continued

I-196

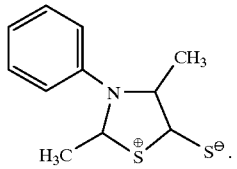

I-197

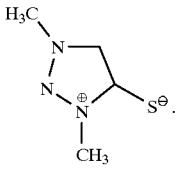

The compounds of formula (I) may be used alone or in admixture of two or more. These compounds may be added in any desired form including powder, solutions in organic solvents and water, and solid particle dispersions. Preferably the compound of formula (I) is added to the photosensitive layer substantially at the same time as the compound of formula (II), for example, by adding the compound of formula (I) to a coating solution together with the compound of formula (II).

Preferably, the compound of formula (I) is added in an amount of 10 to 1,000 mol, more preferably 20 to 400 mol per mol of the compound of formula (II). Outside this range, less amounts of the compound of formula (I) would be ineffective for its purpose whereas more amounts of the compound of formula (I) would adversely affect storage stability.

Next, the compound of formula (II) is described in detail.

(II)

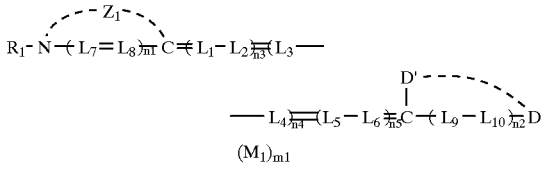

$Z_1$ is a group of atoms necessary to form a 5- or 6-membered nitrogenous heterocycle. Examples of the nucleus formed by $Z_1$ include thiazole nuclei, for example, thiazole, 4-methylthiazole, 4-phenylthiazole, 4,5-dimethylthiazole, and 4,5-diphenylthiazole;

benzothiazole nuclei, for example, benzothiazole, 4-chlorobenzothiazole, 5-chlorobenzothiazole, 6-chlorobenzothiazole, 5-nitrobenzothiazole, 4-methylbenzothiazole, 5-methylbenzothiazole, 6-methylbenzothiazole, 5-bromobenzothiazole, 6-bromobenzothiazole, 5-iodobenzothiazole, 5-methoxybenzothiazole, 6-methoxybenzothiazole, 5-ethoxybenzothiazole, 5-ethoxycarbonylbenzothiazole, 5-carboxybenzothiazole, 5-phenethylbenzothiazole, 5-fluorobenzothiazole, 5-chloro-6-methylbenzothiazole, 5,6-dimethylbenzothiazole, 5,6-dimethoxybenzothiazole, 5-hydroxy-6-methylbenzothiazole, tetrahydrobenzothiazole, and 5-phenylbenzothiazole;

naphthothiazole nuclei, for example, naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, and 5-methoxynaphtho[2,3-d]thiazole;

thiazoline nuclei, for example, thiazoline, 4-methylthiazoline, and 4-nitrothiazoline;

oxazole nuclei, for example, oxazole, 4-methyloxazole, 4-nitrooxazole, 5-methyloxazole, 4-phenyloxazole, 4,5-diphenyloxazole, and 4-ethyloxazole;

benzoxazole nuclei, for example, benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, and 5-ethoxybenzoxazole;

naphthoxazole nuclei, for example, naphth[2,1-d]oxazole, naphth[1,2-d]oxazole, naphth[2,3-d]oxazole, 5-nitronaphth[2,1-d]oxazole;

oxazoline nuclei, for example, 4,4-dimethyloxazoline;

selenazole nuclei, for example, 4-methylselenazole, 4-nitroselanazole, and 4-phenylselenazole;

benzoselenazole nuclei, for example, benzoselenazole, 5-chlorobenzoselenazole, 5-nitrobenzoselenazole, 5-methoxybenzoselenazole, 5-hydroxybenzoselenazole, 6-nitrobenzoselenazole, 5-chloro-6-nitrobenzoselenazole, and 5,6-dimethylbenzoselenazole;

naphthoselenazole nuclei, for example, naphtho[2,1-d]selenazole and naphtho[1,2-d]selenazole;

selenazoline nuclei, for example, selenazoline and 4-methylselenazoline;

tellurazole nuclei, for example, tellurazole, 4-methyltellurazole, and 4-phenyltellurazole;

benzotellurazole nuclei, for example, benzotellurazole, 5-chlorobenzotellurazole, 5-methylbenzotellurazole, 5,6-dimethylbenzotellurazole, and 6-methoxybenzotellurazole;

naphthotellurazole nuclei, for example, naphtho[2,1-d]tellurazole and naphtho[1,2-d]tellurazole;

tellurazoline nuclei, for example, tellurazoline and 4-methyltellurazoline;

3,3-dialkylindolenine nuclei, for example, 3,3-dimethylindolenine, 3,3-diethylindolenine, 3,3-dimethyl-5-cyanoindolenine, 3,3-dimethyl-6-nitroindolenine, 3,3-dimethyl-5-nitroindolenine, 3,3-dimethyl-5-methoxyindolenine, 3,3,5-trimethylindolenine, and 3,3-dimethyl-5-chloroindolenine;

imidazole nuclei, for example, 1-alkylimidazoles, 1-alkyl-4-phenylimidazoles, and 1-arylimidazoles;

benzimidazole nuclei, for example, 1-alkylbenzimidazoles, 1-alkyl-5-chlorobenzimidazole, 1-alkyl-5,6-dichlorobenzimidazole, 1-alkyl-5-methoxybenzimidazoles, 1-alkyl-5-cyanobenzimidazoles, 1-alkyl-5-fluorobenzimidazoles, 1-alkyl-5-trifluoromethylbenzimidazoles, 1-alkyl-6-chlorocyanobenzimidazoles, 1-alkyl-6-chloro-5-trifluorobenzimidazoles, 1-alkenyl-5,6-dichlorobenzimidazole, 1-alkenyl-5-chlorobenzimidazole, 1-arylbenzimidazoles, 1-aryl-5-chlorobenzimidazoles, 1-aryl-5,6-dichlorobenzimidazoles, 1-aryl-5-methoxybenzimidazoles, and 1-aryl-5-cyanobenzimidazoles;

naphthimidazole nuclei, for example, alkylnaphth[1,2-d]imidazoles and 1-arylnaphth[1,2-d]imidazoles;

with the proviso that the alkyl groups are those of 1 to 8 carbon atoms, for example, unsubstituted alkyl groups such as methyl, ethyl, propyl, isopropyl, and butyl, hydroxyalkyl groups such as 2-hydroxyethyl and 3-hydroxypropyl, preferably methyl and ethyl and that the aryl groups are typically phenyl, halogen-substituted phenyl (e.g., chlorophenyl), alkyl-substituted phenyl (e.g., methylphenyl), and alkoxy-substituted phenyl (e.g., methoxyphenyl);

pyridine nuclei, for example, 2-pyridine, 4-pyridine, 5-methyl-2-pyridine, and 3-methyl-4-pyridine;

quinoline nuclei, for example, 2-quinoline, 3-methyl-2-quinoline, 5-ethyl-2-quinoline, 6-methyl-2-quinoline, 6-nitro-2-quinoline, 8-fluoro-2-quinoline, 6-methoxy-2-quinoline, 6-hydroxy-2-quinoline, 8-chloro-2-quinoline, 4-quinoline, 6-ethoxy-4-quinoline, 6-phenyl-4-quinoline, 8-chloro-4-quinoline, 8-fluoro-4-quinoline, 8-methyl-4-quinoline, 8-methoxy-4-quinoline, 6-methyl-4-quinoline, 6-methoxy-4-quinoline, and 6-chloro-4-quinoline;

isoquinoline nuclei, for example, 6-nitro-1-isoquinoline, 3,4-dihydro-1-isoquinoline, and 6-nitro-3-isoquinoline;

imidazo[4,5-b]quinoxaline nuclei, for example, 1,3-diethylimidazo[4,5-b]quinoxaline and 6-chloro-1,3-diallylimidazo[4,5-b]quinoxaline;

oxadiazole nuclei, thiadiazole nuclei, tetrazole nuclei, and pyrimidine nuclei.

Preferred examples of the nucleus formed by $Z_1$ are benzothiazole, naphthothiazole, benzoxazole, naphthoxazole, benzimidazole, 2-quinoline, and 4-quinoline nuclei.

Each of D and D' is a group of atoms necessary to form an acyclic or cyclic acidic nucleus, which may take the form of an acidic nucleus of any ordinary merocyanine dye. In one preferred embodiment, D is a thiocarbonyl or carbonyl group and D' is a group of remaining atoms necessary to form an acidic nucleus.

D and D', taken together, form a 5- or 6-membered heterocycle consisting of carbon, nitrogen, and chalcogen (typically oxygen, sulfur, selenium, and tellurium) atoms. Preferred examples of the nucleus completed by D and D' include nuclei of 2-pyrazolin-5-one, pyrazolidine-3,5-dione, imidazolin-5-one, hydantoin, 2- or 4-thiohydantoin, 2-iminooxazolidin-4-one, 2-oxazolin-5-one, 2-thiooxazolidine-2,4-dione, isooxazolin-5-one, 2-thiazolin-4-one, thiazolidin-4-one, thiazolidine-2,4-dione, rhodanine, thiazolidine-2,4-dithion, isorhodanine, indane-1,3-dione, thiophen-3-one, thiophen-3-one-l,1-dioxide, indolin-2-one, indolin-3-one, indazolin-3-one, 2-oxoindazolinium, 3-oxoindazolinium, 5,7-dioxo-6,7-dihydrothiazolo[3,2-a]pyrimidine, cyclohexane-1,3-dione, 3,4-dihydroisoquinolin-4-one, 1,3-dioxane-4,6-dione, barbituric acid, 2-thiobarbituric acid, chroman-2,4-dione, indazolin-2-one, and pyrido[1,2-a]pyrimidine-1,3-dione, as well as nuclei having an exo-methylene structure wherein the carbonyl or thiocarbonyl group of the foregoing nuclei is replaced by an active methylene site of an active methylene compound having such a structure as ketomethylene and cyanomethylene. More preferred are nuclei of 3-alkylrhodanine, 3-alkyl-2-thiooxazolidine-2,4-dione, and 3-alkyl-2-thiohydantoin, especially those nuclei having at least one carboxyl group in their molecule.

Preferred examples of the substituent attached to the nitrogen atom contained in the nucleus include a hydrogen atom; alkyl groups of 1 to 18 carbon atoms, preferably 1 to 7 carbon atoms, more preferably 1 to 4 carbon atoms (e.g., methyl, ethyl, propyl, isopropyl, butyl, isobutyl, hexyl, octyl, dodecyl, and octadecyl); substituted alkyl groups, for example, aralkyl groups (e.g., benzyl and 2-phenylethyl), hydroxyalkyl groups (e.g., 2-hydroxyethyl and 3-hydroxypropyl), mercaptoalkyl groups (e.g., 2-mercaptoethyl), carboxyalkyl groups (e.g., 2-carboxyethyl, 3-carboxypropyl, 4-carboxybutyl, and carboxymethyl), alkoxyalkyl groups (e.g., 2-methoxyethyl, 2-(2-hydroxyethoxy)ethyl, and 2-(2-methoxyethoxy)ethyl), aryloxyalkyl groups (e.g., 1-naphthyloxyethyl), sulfoalkyl groups (e.g., 2-sulfoethyl, 3-sulfopropyl, 3-sulfobutyl, 4-sulfobutyl, 2-(3-sulfopropoxy)ethyl, 2-hydroxy-3-sulfopropyl, and 3-sulfopropoxyethoxyethyl), sulfatoalkyl groups (e.g., 3-sulfatopropyl and 4-sulfatobutyl), arylthioalkyl groups (e.g., phenylthioethyl), heterocycle-substituted alkyl groups (e.g., 2-(pyrrolidin-2-one-1-yl)ethyl, tetrahydrofurfuryl, and 2-morpholinoethyl), 2-acetoxyethyl, carbomethoxymethyl, and 2-methanesulfonylaminoethyl); allyl group; aryl groups (e.g., phenyl and 2-naphthyl); substituted aryl groups (e.g., 4-carboxyphenyl, 4-sulfophenyl, 3-chlorophenyl, and 3-methylphenyl); and heterocyclic groups (e.g., 2-pyridyl, 2-thiazolyl, 5-pyrazolyl, and 3-methyl-5-pyrazolyl). More preferred substituents are unsubstituted alkyl groups (e.g., methyl, ethyl, n-propyl, n-butyl, n-pentyl, and n-hexyl), carboxyalkyl groups (e.g., carboxymethyl and 2-carboxyethyl), and sulfoalkyl groups (e.g., 2-sulfoethyl).

The nucleus may have a substituent attached to the carbon atom therein, examples of which are as exemplified for the substituent on the polycyclic nucleus of $Z_1$.

Each of $L_1$, $L_2$, $L_3$, $L_4$, $L_5$, $L_6$, $L_7$, $L_8$, $L_9$, and $L_{10}$ is a substituted or unsubstituted methine group, which may form a ring with another methine group or a ring with an auxochrome. Exemplary substituents on the methine group include substituted or unsubstituted alkyl groups such as methyl, ethyl, and 2-carboxyethyl, substituted or unsubstituted aryl groups such as phenyl and o-carboxyphenyl, heterocyclic groups such as thienyl and barbituric acid, halogen atoms such as chlorine and bromine, alkoxy groups such as methoxy and ethoxy, amino groups such as N,N-diphenylamino, N-methyl-N-phenylamino, and N-methylpiperazino, and alkylthio groups such as methylthio and ethylthio.

Preferably either one set of $L_2$ and $L_4$, and $L_3$ and $L_5$, taken together, form a ring.

Preferred examples of the ring structure formed by $L_2$ and $L_4$ are given below.

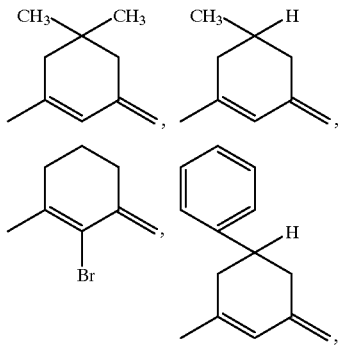

Preferred examples of the ring structure formed by $L_3$ and $L_5$ are given below.

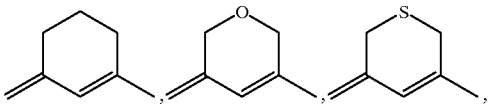

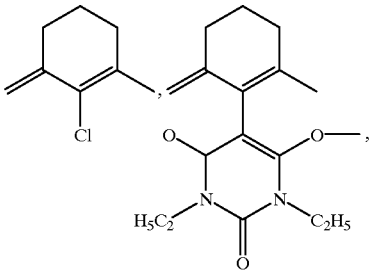

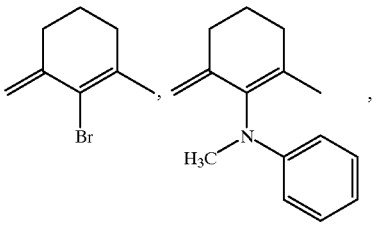

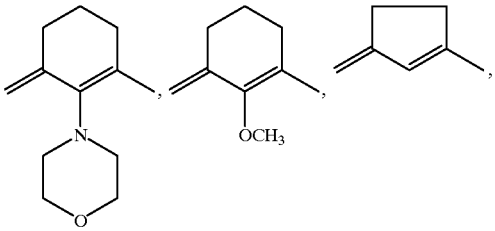

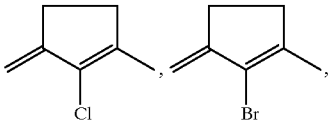

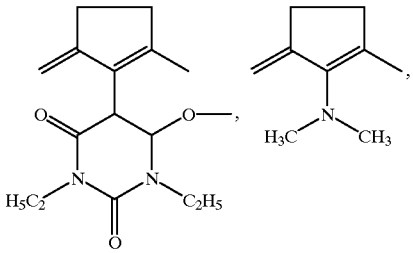

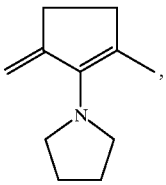

$L_4$ is preferably selected from unsubstituted methine groups, substituted methine groups having an unsubstituted alkyl group (e.g., methyl), alkoxy group (e.g., methoxy), amino group (e.g., N,N-diphenylamino) or halogen atom (e.g., chlorine), and substituted methine groups having an acidic nucleus as represented by D and D'.

The remaining L's are preferably unsubstituted methine groups.

Letters n1, n2, n3, n4, and n5 each are equal to 0 or 1.

$R_1$ is an alkyl group. Preferred examples of the alkyl group represented by $R_1$ include unsubstituted alkyl groups of up to 18 carbon atoms such as methyl, ethyl, propyl, pentyl, octyl, decyl, dodecyl, and octadecyl, and substituted alkyl groups of up to 18 carbon atoms. Exemplary substituents on the alkyl groups include a carboxyl group, sulfo group, cyano group, halogen atom (e.g., fluorine, chlorine and bromine), hydroxy group, substituted or unsubstituted alkoxycarbonyl groups of up to 8 carbon atoms (e.g., methoxycarbonyl, ethoxycarbonyl, phenoxycarbonyl, and benzyloxycarbonyl), substituted or unsubstituted alkoxy groups of up to 8 carbon atoms (e.g., methoxy, ethoxy, benzyloxy, and phenethyloxy), substituted or unsubstituted aryloxy groups of up to 20 carbon atoms (e.g., phenoxy, p-tolyloxy, 1-naphthyloxy, 2-naphthyloxy, and 6-methoxy-1-naphthyloxy), substituted or unsubstituted acyloxy groups of up to 3 carbon atoms (e.g., acetyloxy and propionyloxy), substituted or unsubstituted acyl groups of up to 8 carbon atoms (e.g., acetyl, propionyl, benzoyl, and mesyl), substituted or unsubstituted acylamino groups of up to 10 carbon atoms (e.g., acetylamino and 2-mercapto-6-benzimidazolylcarbonylamino), substituted or unsubstituted carbamoyl groups of up to 8 carbon atoms (e.g., carbamoyl, N,N-dimethylcarbamoyl, morpholinocarbonyl, and piperidinocarbonyl), substituted or unsubstituted sulfamoyl groups of up to 8 carbon atoms (e.g., sulfamoyl, N,N-dimethylsulfamoyl, morpholinosulfonyl, and piperidinosulfonyl), and substituted or unsubstituted aryl groups of up to 10 carbon atoms (e.g., phenyl, 4-chlorophenyl, 4-methylphenyl, and α-naphthyl). Preferred alkyl groups are unsubstituted alkyl groups such as methyl, ethyl, n-propyl, n-butyl, n-pentyl, and n-hexyl, carboxyalkyl groups such as 2-carboxyethyl and carboxymethyl, sulfoalkyl groups such as 2-sulfoethyl, 3-sulfopropyl, 4-sulfobutyl, and 3-sulfobutyl.

$M_1$ is an electric charge neutralizing counter ion, and letter m1 is an integer inclusive of 0 necessary to neutralize an electric charge in a molecule.

$(M_1)_{m1}$ is included in the formula in order to represent the presence or absence of a cation or anion when necessary to neutralize an ionic charge on the dye. Whether a certain dye is a cation or anion or whether or not a certain dye has a net ionic charge depends on its auxochrome and substituent. The cation is typically an inorganic or organic ammonium ion or alkali metal ion. The anion may be either an inorganic anion or an organic anion, for example, halide ions (e.g., fluoride, chloride, bromide and iodide ions), substituted arylsulfonate ions (e.g., p-toluenesulfonate ion and p-chlorobenzenesulfonate ion), aryldisulfonate ions (e.g., 1,3-benzenedisulfonate ion, 1,5-naphthalenedisulfonate ion, and 2,6-naphthalenedisulfonate ion), alkylsulfate ions (e.g., methylsulfate ion), sulfate ion, thiocyanate ion, perchlorate ion, tetrafluoroborate ion, picrate ion, acetate ion, and trifluoromethanesulfonate ion. Preferred are ammonium, iodide, and p-toluenesulfonate ions.

Typical, non-limiting, examples of the methine dye of the general formula (II) are given below. Note that $R_3$ appearing in II-12 is hydrogen or a substituent (e.g., methyl) as exemplified for L.

II-1.
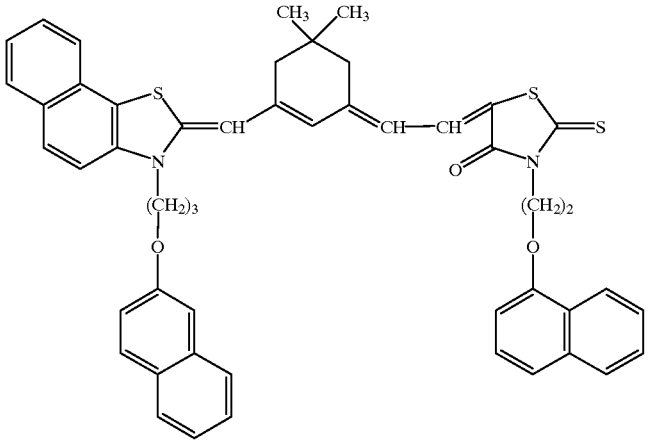
II-2.
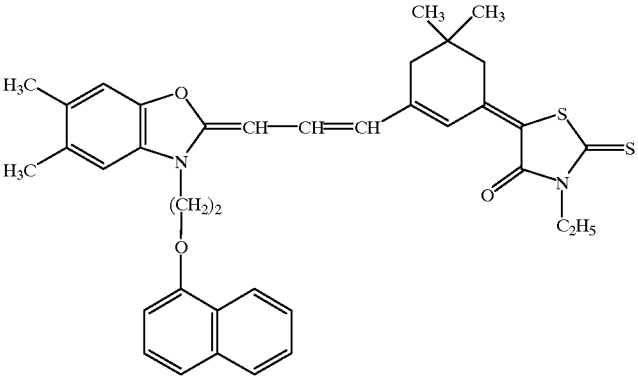
II-3.
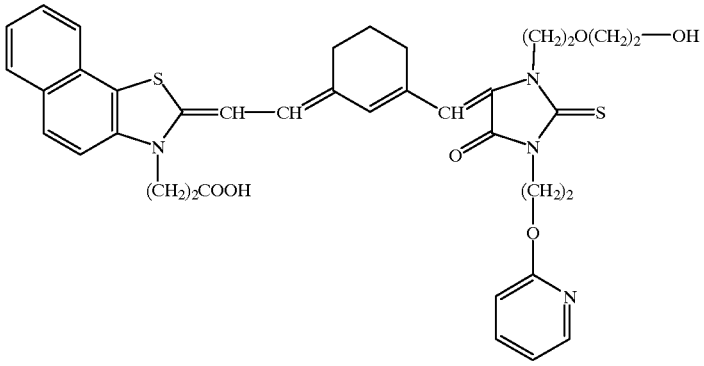
II-4.
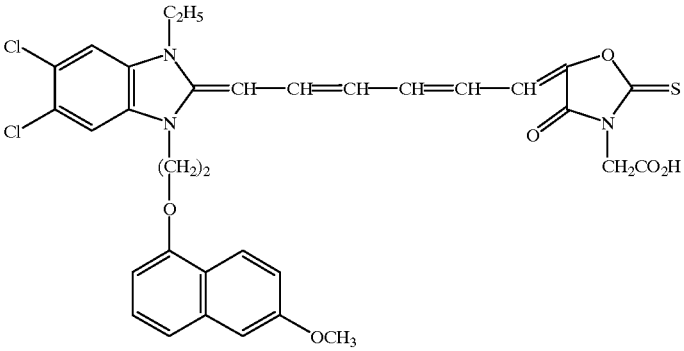

-continued
II-5.
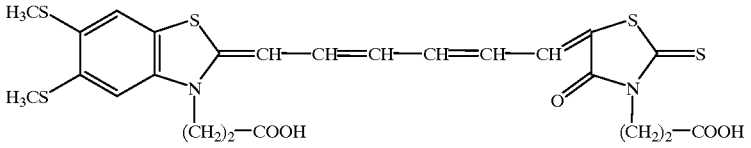
II-6.
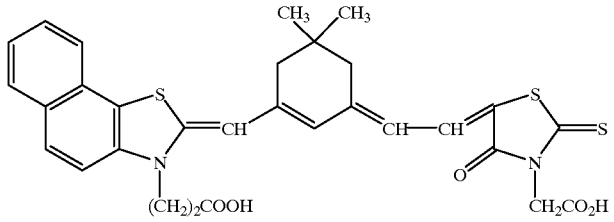
II-7.
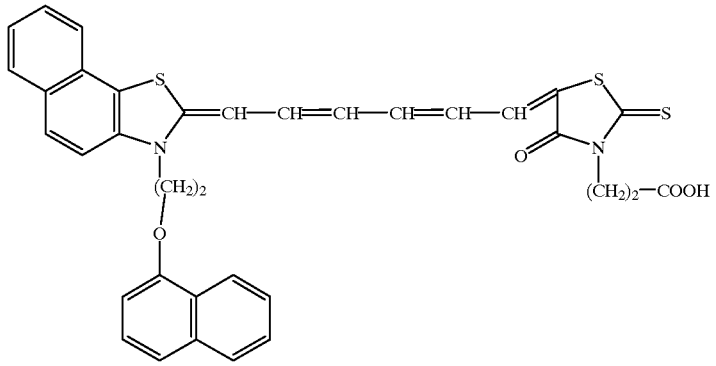
II-8.
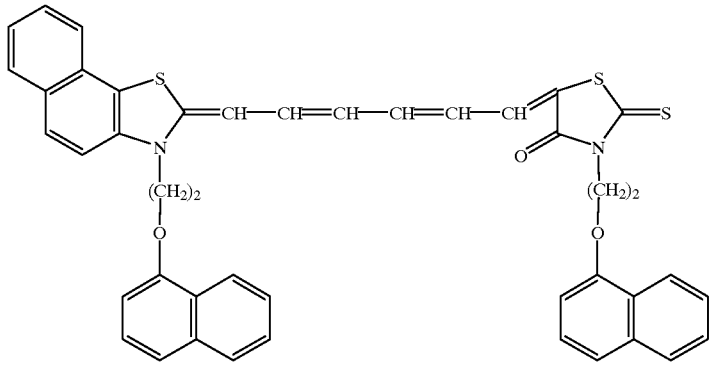
II-9
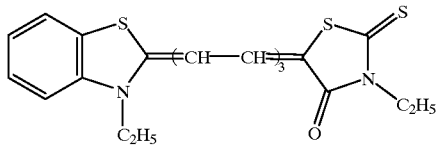

-continued
II-10
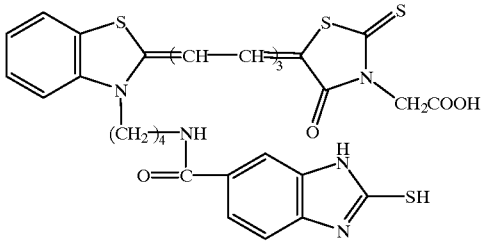
II-11
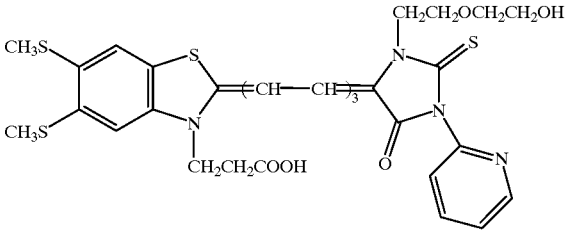
II-12
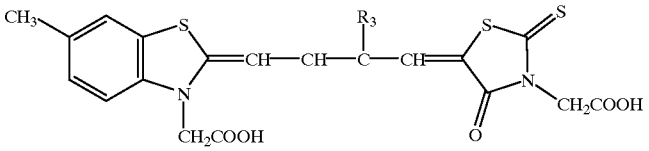
II-13
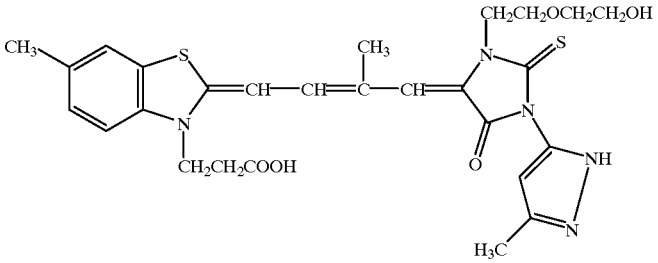
II-14
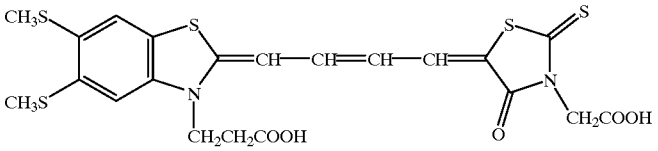
II-15
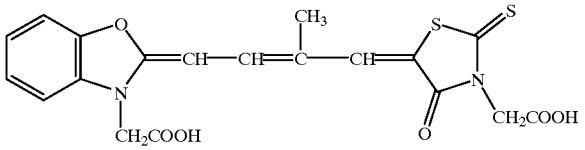
II-16
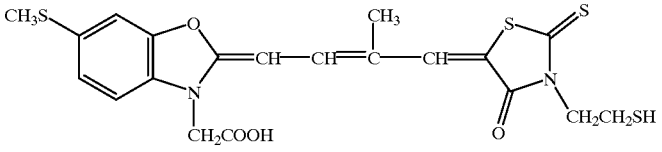

-continued
II-17
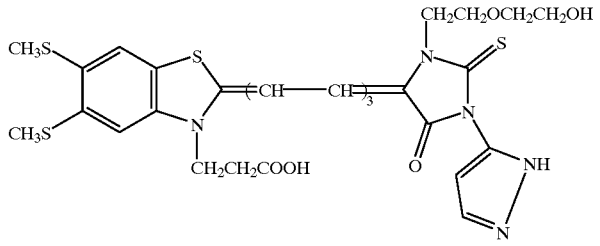
II-18
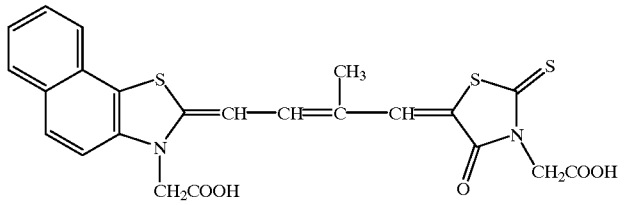
II-19
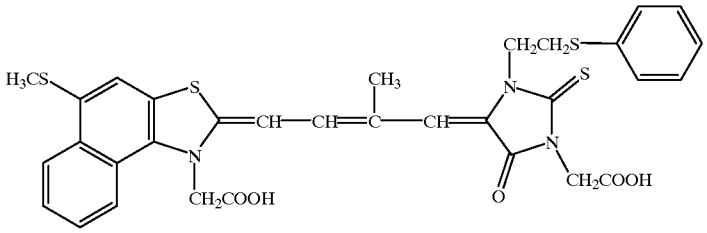
II-20
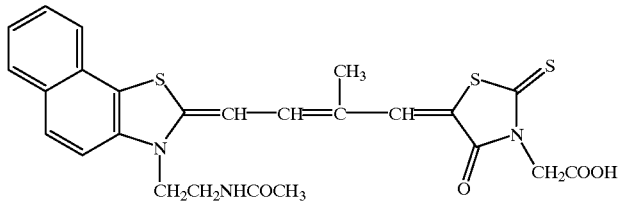
II-21
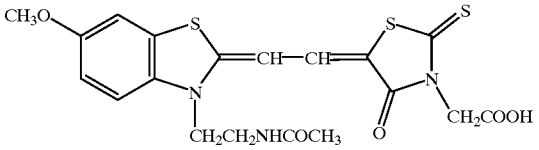
II-22
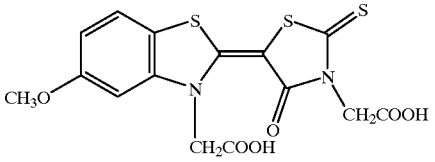

-continued

II-23

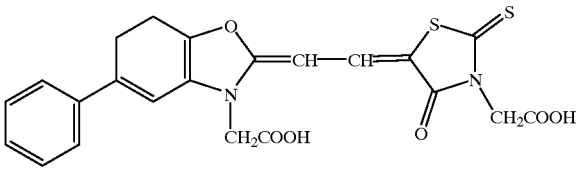

II-24

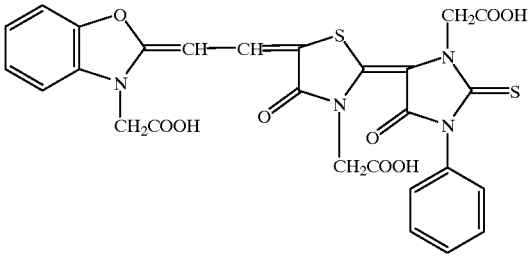

II-25

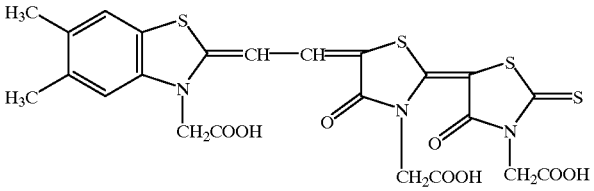

II-26

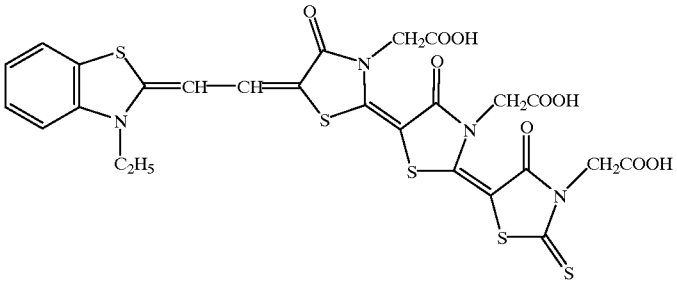

II-27

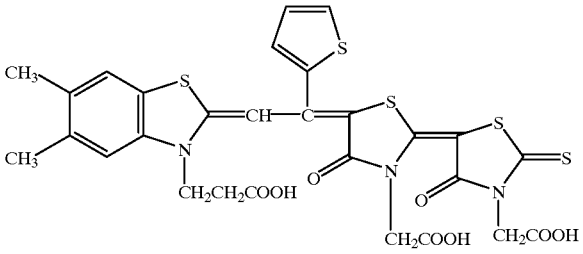

The amount of the compound of formula (II) may be properly determined in accordance with a desired sensitivity and fog although it is preferably $10^{-6}$ to 1 mol, more preferably $10^{-4}$ to $10^{-1}$ mol per mol of the silver halide in the photosensitive layer.

The merocyanine dyes of the formula (II) can be synthesized by the methods described in the following literature:

a) F. M. Hamer, "Heterocyclic Compounds—Cyanine Dyes and Related Compounds," John Wiley & Sons, New York and London, 1964, b) D. M. Sturmer, "Heterocyclic Compounds—Special topics in heterocyclic chemistry," Chapter 18, §4, pp. 482–515, John Wiley & Sons, New York and London, 1977, c) Zh. Org. Khim., vol. 17, No. 1, pp. 167–169 (1981), vol. 15, No. 2, pp. 400–407 (1979), vol. 14, No. 10, pp. 2214–2221 (1978), vol. 13, No. 11, pp. 2440–2443 (1977), vol. 19, No. 10, pp. 2134–2142 (1982), Ukr. Khim. Zh., vol. 40, No. 6, pp. 625–629 (1974), Khim. Geterotsikl. soedin., No. 2, pp. 175–178 (1976), Russian Patent Nos. 420,643 and 341,823, JP-A 46930/1974, 217761/1984, and 243944/1991, U.S. Pat. Nos. 4,334,000, 3,671,648, 3,623,881, 3,573,921, EP 288261A1, 102781A2, and 730008A2.

The photosensitive layer containing photosensitive silver halide grains according to the invention should have an absorbance of 0.15 to 1.0, preferably 0.2 to 0.5 at an exposure wavelength. As previously described, if the absorption increases to an absorbance in excess of 1.0, Dmin increases so that the image becomes difficult to discriminate. If the absorption decreases to an absorbance of less than 0.15, sharpness is lost. The photosensitive layer containing photosensitive silver halide grains according to the invention should preferably exhibit an absorption maximum at the exposure wavelength ±50 nm, more preferably the exposure wavelength ±20 nm.

The absorbance is determined by coating a photosensitive layer on one surface of a support to form a sample, placing the sample relative to a light source such that the emulsion layer surface faces the light source, measuring the absorbance of the sample, and subtracting the absorbance of the support as a reference therefrom. Absorbance measurement can also be done using a sample having a protective layer formed on the photosensitive layer if the protective layer provides no absorption.

Where the photothermographic material of the invention has a plurality of photosensitive layers, all the photosensitive layers should preferably satisfy the above-defined range of absorbance. Where a plurality of photosensitive layers are present, the overall absorbance is determined using a sample in which photosensitive layers of the same construction as in the photothermographic material are formed on one surface of a support. The absorbance can also be determined by preparing a corresponding plurality of samples each having one photosensitive layer.

Where the photothermographic material of the invention has a photosensitive layer on each surface of a support, the absorbance of the photosensitive layers is determined by preparing two samples in each of which photosensitive layers of the same construction as on side surface of the photothermographic material are formed on one surface of a support.

Any desired method may be used to render absorptive the photosensitive layer containing photosensitive silver halide grains according to the invention although the use of dyestuffs is preferred. Any desired dyestuff may be used insofar as it can impart the absorption in the above-defined range. Exemplary dyestuffs include pyrazoloazole, anthraquinone, azo, azomethine, oxonol, carbocyanine, styryl, triphenylmethane, indoaniline, and indophenol dyestuffs. Preferred examples of the dyestuff used herein include anthraquinone dyestuffs (e.g., compounds 1 to 9 in JP-A 341441/1993, compounds 3–6 to 3–18 and 3–23 to 3–38 in JP-A 165147/1993), azomethine dyestuffs (e.g., compounds 17 to 47 in JP-A 341441/1993), indoaniline dyestuffs (e.g., compounds 11 to 19 in JP-A 289227/1993, compound 47 in JP-A 341441/1993, compounds 2–10 and 2–11 in JP-A 165147/1993), and azo dyestuffs (e.g., compounds 10 to 16 in JP-A 341441/1993). These dyestuffs may be added in any desired form including solutions, emulsions, and solid particle dispersions or in a state mordanted with polymeric mordants. The amount of the dyestuff used is determined in accordance with the desired absorption although it is preferred to use 1 μg to 1 g of the dyestuff per square meter of the photosensitive material. The compound used for imparting absorption to the photosensitive layer or emulsion layer according to the invention is not limited to the aforementioned examples although the following examples are preferred.

III-1

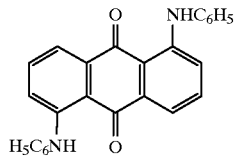

III-2

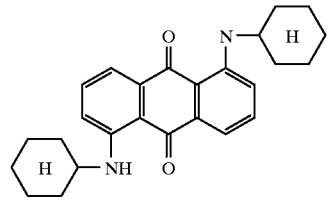

III-3

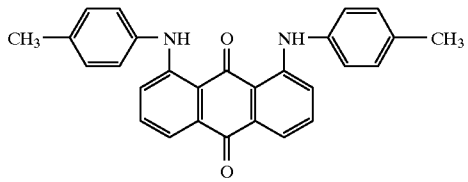

III-4

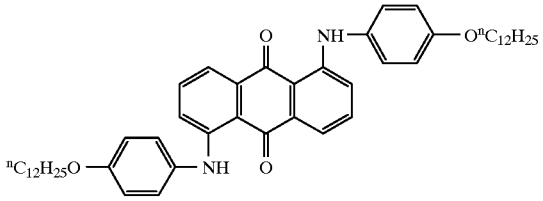

III-5

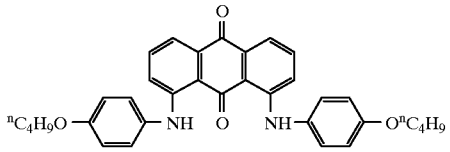

III-6

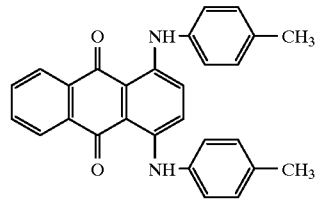

-continued

III-7

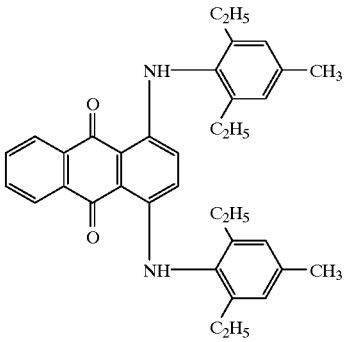

III-8

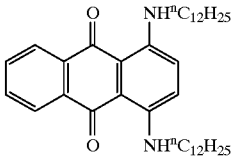

III-9

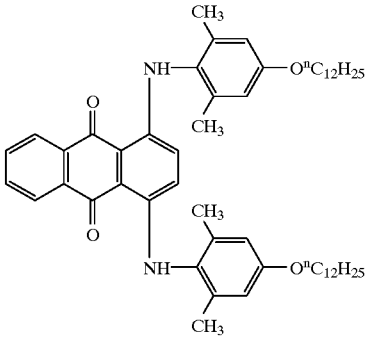

III-10

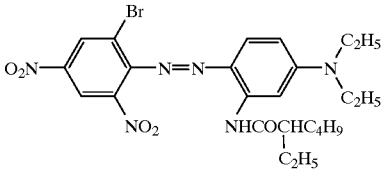

III-11

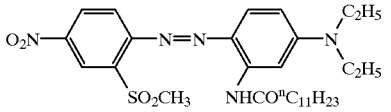

III-12

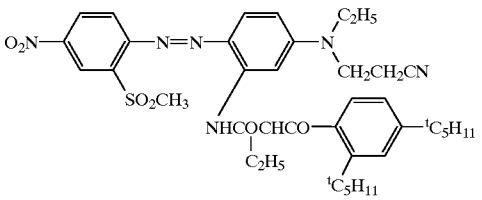

-continued

III-13

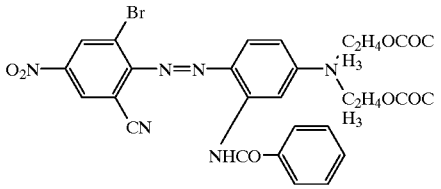

III-14

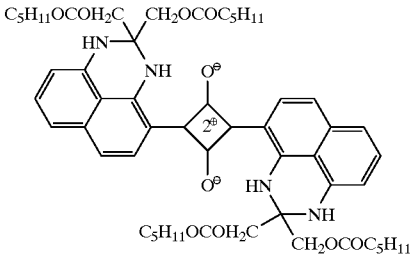

organic silver salt

The organic silver salt used herein is relatively stable to light, but forms a silver image when heated at 80° C. or higher in the presence of an exposed photocatalyst (as typified by a latent image of photosensitive silver halide) and a reducing agent. The organic silver salt may be of any desired organic compound containing a source capable of reducing silver ion. Preferred are silver salts of organic acids, typically long chain aliphatic carboxylic acids having 10 to 30 carbon atoms, especially 15 to 28 carbon atoms. Also preferred are complexes of organic or inorganic silver salts with ligands having a stability constant in the range of 4.0 to 10.0. A silver-providing substance is preferably used in an amount of about 5 to 70% by weight of an image forming layer. Preferred organic silver salts include silver salts of organic compounds having a carboxyl group. Examples include silver salts of aliphatic carboxylic acids and silver salts of aromatic carboxylic acids though not limited thereto. Preferred examples of the silver salt of aliphatic carboxylic acid include silver behenate, silver stearate, silver oleate, silver laurate, silver caproate, silver myristate, silver palmitate, silver maleate, silver fumarate, silver tartrate, silver linolate, silver butyrate, silver camphorate and mixtures thereof.

Silver salts of compounds having a mercapto or thion group and derivatives thereof are also useful. Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(ethylglycolamido) benzothiazole, silver salts of thioglycolic acids such as silver salts of S-alkylthioglycolic acids wherein the alkyl group has 12 to 22 carbon atoms, silver salts of dithiocarboxylic acids such as a silver salt of dithioacetic acid, silver salts of thioamides, a silver salt of 5-carboxyl-1-methyl-2-phenyl-4-thiopyridine, silver salts of mercaptotriazines, a silver salt of 2-mercaptobenzoxazole as well as silver salts of 1,2,4-mercaptothiazole derivatives such as a silver salt of 3-amino-5-benzylthio-1,2,4-thiazole as described in U.S. Pat. No. 4,123,274 and silver salts of thion compounds such as a silver salt of 3-(3-carboxyethyl)-4-methyl-4-thiazoline-2-thion as described in U.S. Pat. No. 3,301,768. Compounds containing an imino group may also be used. Preferred examples of these compounds include silver salts of benzotriazole and derivatives thereof, for example, silver salts of benzotriazoles such as silver methylbenzotriazole, silver salts of halogenated benzotriazoles such as silver 5-chlorobenzotriazole as well as silver salts of 1,2,4-triazole and l-H-tetrazole and silver salts of imidazole and imidazole derivatives as described in U.S. Pat. No. 4,220,709. Also useful are various silver acetylide compounds as described, for example, in U.S. Pat. Nos. 4,761,361 and 4,775,613.

The organic silver salt which can be used herein may take any desired shape although needle crystals having a minor axis and a major axis are preferred. In the practice of the invention, grains should preferably have a minor axis of 0.01 μm to 0.20 μm, more preferably 0.01 μm to 0.15 μm and a major axis of 0.10 μm to 5.0 μm, more preferably 0.10 μm to 4.0 μm. The grain size distribution is desirably monodisperse. The monodisperse distribution means that a standard deviation of the length of minor and major axes divided by the length, respectively, expressed in percent, is preferably up to 100%, more preferably up to 80%, most preferably up to 50%. It can be determined from the measurement of the shape of organic silver salt grains using an image obtained through a transmission electron microscope. Another method for determining a monodisperse distribution is to determine a standard deviation of a volume weighed mean diameter. The standard deviation divided by the volume weighed mean diameter, expressed in percent, which is a coefficient of variation, is preferably up to 100%, more preferably up to 80%, most preferably up to 50%. It may be determined by irradiating laser light, for example, to organic silver salt grains dispersed in liquid and determining the autocorrelation function of the fluctuation of scattering light relative to a time change, and obtaining the grain size (volume weighed mean diameter) therefrom.

The organic silver salt used herein is preferably desalted. The desalting method is not critical. Any well-known method may be used although well-known filtration methods such as centrifugation, suction filtration, ultrafiltration, and flocculation/water washing are preferred.

In the practice of the invention, the organic silver salt is prepared into a solid microparticulate dispersion using a dispersant in order to provide fine particles of small size and free of flocculation. A solid microparticulate dispersion of the organic silver salt may be prepared by mechanically dispersing the salt in the presence of dispersing aids by well-known comminuting means such as ball mills, vibrating ball mills, planetary ball mills, sand mills, colloidal mills, jet mills, and roller mills.

The dispersant used in the preparation of a solid microparticulate dispersion of the organic silver salt may be selected from synthetic anionic polymers such as polyacrylic acid, copolymers of acrylic acid, copolymers of maleic acid, copolymers of maleic acid monoester, and copolymers of acryloylmethylpropanesulfonic acid; semisynthetic anionic polymers such as carboxymethyl starch and carboxymethyl cellulose; anionic polymers such as alginic acid and pectic acid; anionic surfactants as described in JP-A 92716/1977 and WO 88/04794; the compounds described in Japanese Patent Application No. 350753/1995; well-known anionic, nonionic and cationic surfactants; and well-known polymers such as polyvinyl alcohol, polyvinyl pyrrolidone, carboxymethyl cellulose, hydroxypropyl cellulose, and hydroxypropylmethyl cellulose, as well as naturally occurring high molecular weight compounds such as gelatin.

In general, the dispersant is mixed with the organic silver salt in powder or wet cake form prior to dispersion. The resulting slurry is fed into a dispersing machine. Alternatively, a mixture of the dispersant with the organic silver salt is subject to heat treatment or solvent treatment to form a dispersant-bearing powder or wet cake of the organic silver salt. It is acceptable to effect pH control with a suitable pH adjusting agent before, during or after dispersion.

Rather than mechanical dispersion, fine particles can be formed by roughly dispersing the organic silver salt in a solvent through pH control and thereafter, changing the pH in the presence of dispersing aids. An organic solvent can be used as the solvent for rough dispersion although the organic solvent is usually removed at the end of formation of fine particles.

The thus prepared dispersion may be stored while continuously stirring for the purpose of preventing fine particles from settling during storage. Alternatively, the dispersion is stored after adding hydrophilic colloid to establish a highly viscous state (for example, in a jelly-like state using gelatin). An antiseptic agent may be added to the dispersion in order to prevent the growth of bacteria during storage.

The organic silver salt is used in any desired amount, preferably about 0.1 to 5 g per square meter of photosensitive material, more preferably about 1 to 3 g/m$^2$.

Silver halide

A method for forming a photosensitive silver halide is well known in the art. Any of the methods disclosed in Research Disclosure No. 17029 (June 1978) and U.S. Pat. No. 3,700,458, for example, may be used. Illustrative methods which can be used herein are a method of adding a halogen-containing compound to a pre-formed organic silver salt to convert a part of silver of the organic silver salt into photosensitive silver halide and a method of adding a silver-providing compound and a halogen-providing compound to a solution of gelatin or another polymer to form photosensitive silver halide grains and mixing the grains with an organic silver salt. The latter method is preferred in the practice of the invention. The photosensitive silver halide should preferably have a smaller grain size for the purpose of minimizing white turbidity after image formation. Specifically, the grain size is less than 0.20 μm, preferably 0.01 μm to 0.15 μm, most preferably 0.02 μm to 0.12 μm. The term grain size designates the length of an edge of a silver halide grain where silver halide grains are regular grains of cubic or octahedral shape. Where silver halide grains are tabular, the grain size is the diameter of an equivalent circle having the same area as the projected area of a major surface of a tabular grain. Where silver halide grains are not regular, for example, in the case of spherical or rod-shaped grains, the grain size is the diameter of an equivalent sphere having the same volume as a grain.

The shape of silver halide grains may be cubic, octahedral, tabular, spherical, rod-like and potato-like, with cubic and tabular grains being preferred in the practice of the invention. Where tabular silver halide grains are used, they should preferably have an average aspect ratio of from 100:1 to 2:1, more preferably from 50:1 to 3:1. Silver halide grains having rounded corners are also preferably used. No particular limit is imposed on the face indices (Miller indices) of an outer surface of silver halide grains. Preferably silver halide grains have a high proportion of {100} face featuring high spectral sensitization efficiency upon adsorption of a spectral sensitizing dye. The proportion of {100} face is preferably at least 50%, more preferably at least 65%, most preferably at least 80%. Note that the proportion of Miller index {100} face can be determined by the method described in T. Tani, J. Imaging Sci., 29, 165 (1985), utilizing the adsorption dependency of {111} face and (100) face upon adsorption of a sensitizing dye.

The halogen composition of photosensitive silver halide is not critical and may be any of silver chloride, silver chlorobromide, silver bromide, silver iodobromide, silver iodochlorobromide, and silver iodide. Silver bromide or silver iodobromide is preferred in the practice of the invention. Most preferred is silver iodobromide preferably having a silver iodide content of 0.1 to 40 mol %, especially 0.1 to 20 mol %. The halogen composition in grains may have a uniform distribution or a non-uniform distribution wherein the halogen concentration changes in a stepped or continuous manner. Preferred are silver iodobromide grains having a higher silver iodide content in the interior. Silver halide grains of the core/shell structure are also useful. Such core/shell grains preferably have a multilayer structure of 2 to 5 layers, more preferably 2 to 4 layers.

Preferably the photosensitive silver halide grains used herein contain at least one complex of a metal selected from the group consisting of rhodium, rhenium, ruthenium, osmium, iridium, cobalt, mercury, and iron. The metal complexes may be used alone or in admixture of two or more complexes of a common metal or different metals. An appropriate content of the metal complex is $1\times10^{-9}$ to $1\times10^{-2}$ mol, more preferably $1\times10^{-8}$ to $1\times10^{-4}$ mol per mol of silver. Illustrative metal complex structures are those described in JP-A 225449/1995. Preferred among cobalt and iron complexes are hexacyano metal complexes. Illustrative, non-limiting examples of cobalt and iron complexes include hexacyano metal complexes such as ferricyanate, ferrocyanate, and hexacyanocobaltate. The distribution of the metal complex in silver halide grains is not critical. That is, the metal complex may be contained in silver halide grains uniformly or at a high concentration in either the core or the shell.

Photosensitive silver halide grains may be desalted by any of well-known water washing methods such as noodle and flocculation methods although silver halide grains may be either desalted or not according to the invention.

The photosensitive silver halide grains used herein should preferably be chemically sensitized. Preferred chemical sensitization methods are sulfur, selenium, and tellurium sensitization methods which are well known in the art. Also useful are a noble metal sensitization method using compounds of gold, platinum, palladium, and iridium and a reduction sensitization method. In the sulfur, selenium, and tellurium sensitization methods, any of compounds well known for the purpose may be used. For example, the compounds described in JP-A 128768/1995 are useful. Exemplary tellurium sensitizing agents include diacyltellurides, bis(oxycarbonyl)tellurides, bis(carbamoyl) tellurides, bis(oxycarbonyl)ditellurides, bis(carbamoyl) ditellurides, compounds having a P—Te bond, tellurocarboxylic salts, Te-organyltellurocarboxylic esters, di(poly) tellurides, tellurides, telluroles, telluroacetals, tellurosulfonates, compounds having a P—Te bond, Te-containing heterocyclics, tellurocarbonyl compounds, inorganic tellurium compounds, and colloidal tellurium. The preferred compounds used in the noble metal sensitization method include chloroauric acid, potassium chloroaurate, potassium aurithiocyanate, gold sulfide, and gold selenide as well as the compounds described in U.S. Pat. No. 2,448,060 and UKP 618,061. Illustrative examples of the compound used in the reduction sensitization method include ascorbic acid, thiourea dioxide, stannous chloride, aminoiminomethanesulfinic acid, hydrazine derivatives, boran compounds, silane compounds, and polyamine compounds. Reduction sensitization may also be accomplished by ripening the emulsion while maintaining it at pH 7 or higher or at pAg 8.3 or lower. Reduction sensitization may also be accomplished by introducing a single addition portion of silver ion during grain formation.

According to the invention, the photosensitive silver halide is preferably used in an amount of 0.01 to 0.5 mol, more preferably 0.02 to 0.3 mol, most preferably 0.03 to 0.25 mol per mol of the organic silver salt. With respect to a method and conditions of admixing the separately prepared photosensitive silver halide and organic silver salt, there may be used a method of admixing the separately prepared photosensitive silver halide and organic silver salt in a high speed agitator, ball mill, sand mill, colloidal mill, vibratory mill or homogenizer or a method of preparing an organic silver salt by adding a preformed photosensitive silver halide at any timing during preparation of an organic silver salt. Any desired mixing method may be used insofar as the benefits of the invention are fully achievable.

One of the preferred methods for preparing the silver halide according to the invention is a so-called halidation method of partially halogenating the silver of an organic silver salt with an organic or inorganic halide. Any of organic halides which can react with organic silver salts to form a silver halide may be used. Exemplary organic halides are N-halogenoimides (e.g., N-bromosuccinimide), halogenated quaternary nitrogen compounds (e.g., tetrabutylammonium bromide), and aggregates of a halogenated quaternary nitrogen salt and a molecular halogen (e.g., pyridinium bromide perbromide). Any of inorganic halides which can react with organic silver salts to form a silver halide may be used. Exemplary inorganic halides are alkali metal and ammonium halides (e.g., sodium chloride, lithium bromide, potassium iodide, and ammonium bromide), alkaline earth metal halides (e.g., calcium bromide and magnesium chloride), transition metal halides (e.g., ferric chloride and cupric bromide), metal complexes having a halogen ligand (e.g., sodium iridate bromide and ammonium rhodate chloride), and molecular halogens (e.g., bromine, chlorine and iodine). A mixture of organic and inorganic halides may also be used.

The amount of the halide added for the halidation purpose is preferably 1 mmol to 500 mmol, especially 10 mmol to 250 mmol of halogen atom per mol of the organic silver salt.

Reducing agent

The reducing agent for the organic silver salt may be any of substances, preferably organic substances, that reduce silver ion into metallic silver. Conventional photographic developing agents such as Phenidone®, hydroquinone and catechol are useful although hindered phenols are preferred reducing agents. The reducing agent should preferably be contained in an amount of 0.05 to 0.5 mol, especially 0.1 to 0.4 mol per mol of silver on the image forming layer-bearing side. The reducing agent may be added to any layer on the image forming layer-bearing side. In a multilayer embodiment wherein the reducing agent is added to a layer other than the image forming layer, the reducing agent should preferably be contained in a slightly larger amount of about 0.1 to 0.5 mol per mol of silver. The reducing agent may take the form of a precursor which is modified so as to exert its effective function only at the time of development.

For photothermographic materials using organic silver salts, a wide range of reducing agents are disclosed, for example, in JP-A 6074/1971, 1238/1972, 33621/1972, 46427/1974, 115540/1974, 14334/1975, 36110/1975, 147711/1975, 32632/1976, 1023721/1976, 32324/1976, 51933/1976, 84727/1977, 108654/1980, 146133/1981, 82828/1982, 82829/1982, 3793/1994, U.S. Pat. Nos. 3,667,958, 3,679,426, 3,751,252, 3,751,255, 3,761,270, 3,782,949, 3,839,048, 3,928,686, 5,464,738, German Patent No. 2321328, and EP 692732. Exemplary reducing agents include amidoximes such as phenylamidoxime, 2-thienylamidoxime, and p-phenoxyphenylamidoxime; azines such as 4-hydroxy-3,5-dimethoxybenzaldehydeazine; combinations of aliphatic carboxylic acid arylhydrazides with ascorbic acid such as a combination of 2,2-bis(hydroxymethyl)propionyl-β-phenylhydrazine with ascorbic acid; combinations of polyhydroxybenzenes with hydroxylamine, reductone and/or hydrazine, such as combinations of hydroquinone with bis(ethoxyethyl)hydroxylamine, piperidinohexosereductone or formyl-4-methylphenylhydrazine; hydroxamic acids such as phenylhydroxamic acid, p-hydroxyphenylhydroxamic acid, and β-anilinehydroxamic acid; combinations of azines with sulfonamidophenols such as a combination of phenothiazine with 2,6-dichloro-4-benzenesulfonamidephenol; α-cyanophenyl acetic acid derivatives such as ethyl-α-cyano-2-methylphenyl acetate and ethyl-α-cyanophenyl acetate; bis-β-naphthols such as 2,2-dihydroxy-1,1-binaphthyl, 6,6-dibromo-2,2-dihydroxy-1,1-binaphthyl, and bis(2-hydroxy-1-naphthyl)methane; combinations of bis-β-naphthols with 1,3-dihydroxybenzene derivatives such as 2,4-dihydroxybenzophenone and 2,4-dihydroxyacetophenone; 5-pyrazolones such as 3-methyl-1-phenyl-5-pyrazolone; reductones such as dimethylaminohexosereductone, anhydrodihydroaminohexosereductone and anhydrodihydropiperidonehexosereductone; sulfonamidephenol reducing agents such as 2,6-dichloro-4-benzenesulfonamidephenol and p-benzenesulfonamidephenol; 2-phenylindane-1,3-dione, etc.; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl)methane, 2,2-bis(4-hydroxy-3-methylphenyl)propane, 4,4-ethylidene-bis(2-t-butyl-6-methylphenol), 1,1-bis(2-hydroxy-3,5-dimethylphenyl)-3,5,5-trimethylhexane, and 2,2-bis(3,5-dimethyl-4-hydroxyphenyl)propane; ascorbic acid derivatives such as 1-ascorbyl palmitate and ascorbyl stearate; aldehydes and ketones such as benzil and diacetyl; 3-pyrazolidones and certain indane-1,3-diones; and chromanols (tocopherols). Preferred reducing agents are bisphenols and chromanols.

In the practice of the invention, the reducing agent may be added in any desired form, for example, as a solution, powder and solid particle dispersion. The solid particle dispersion of the reducing agent is prepared by well-known finely dividing means such as ball mills, vibratory ball mills, sand mills, colloid mills, jet mills, and roller mills. Dispersing aids may be used in preparing the solid microparticulate dispersion.

Toner

A higher optical density is sometimes achieved when an additive known as a "toner" for improving images is contained. The toner is also sometimes advantageous in forming black silver images. The toner is preferably used in an amount of 0.1 to 50 mol %, especially 0.5 to 20 mol % based on the moles of silver on the image forming layer side. The toner may take the form of a precursor which is modified so as to exert its effective function only at the time of development.

For photothermographic materials using organic silver salts, a wide range of toners are disclosed, for example, in JP-A 6077/1971, 10282/1972, 5019/1974, 5020/1974, 91215/1974, 2524/1975, 32927/1975, 67132/1975, 67641/1975, 114217/1975, 3223/1976, 27923/1976, 14788/1977, 99813/1977, 1020/1978, 76020/1978, 156524/1979, 156525/1979, 183642/1986, and 56848/1992, JP-B 10727/1974 and 20333/1979, U.S. Pat. Nos. 3,080,254, 3,446,648, 3,782,941, 4,123,282, 4,510,236, UKP 1,380,795, and Belgian Patent No. 841,910. Examples of the toner include phthalimide and N-hydroxyphthalimide; cyclic imides such as succinimide, pyrazoline-5-one, quinazoline, 3-phenyl-2-pyrazolin-5-one, 1-phenylurazol, quinazoline and 2,4-thiazolizinedione; naphthalimides such as N-hydroxy-1,8-naphthalimide; cobalt complexes such as cobaltic hexamine trifluoroacetate; mercaptans as exemplified by 3-mercapto-1,2,4-triazole, 2,4-dimercaptopyrimidine, 3-mercapto-4,5-diphenyl-1,2,4-triazole, and 2,5-dimercapto-1,3,4-thiadiazole; N-(aminomethyl)aryldicarboxyimides such as (N,N-dimethylaminomethyl)phthalimide and N,N-(dimethylaminomethyl)-naphthalene-2,3-dicarboxyimide; blocked pyrazoles, isothiuronium derivatives and certain photo-bleach agents such as N,N'-hexamethylenebis(1-carbamoyl-3,5-dimethylpyrazole), 1,8-(3,6-diazaoctane)bis(isothiuroniumtrifluoroacetate) and 2-tribromomethylsulfonyl-benzothiazole; 3-ethyl-5-{(3-ethyl-2-benzothiazolinylidene)-1-methylethylidene}-2-thio-2,4-oxazolidinedione; phthalazinone, phthalazinone derivatives or metal salts, or derivatives such as 4-(1-naphthyl)phthalazinone, 6-chlorophthalazinone, 5,7-dimethoxyphthalazinone and 2,3-dihydro-1,4-phthalazinedione; combinations of phthalazinone with phthalic acid derivatives (e.g., phthalic acid, 4-methylphthalic acid, 4-nitrophthalic acid, and tetrachlorophthalic anhydride); phthalazine, phthalazine derivatives or metal salts, or derivatives such as 4-(1-naphthyl)phthlazine, 6-chlorophthalazine, 5,7-dimethoxyphthalazine and 2,3-dihydrophthlazine; combinations of phthalazine with phthalic acid derivatives (e.g., phthalic acid, 4-methylphthalic acid, 4-nitrophthalic acid, and tetrachlorophthalic anhydride); quinazolinedione, benzoxazine or naphthoxazine derivatives; rhodium complexes which function not only as a tone regulating agent, but also as a source of halide ion for generating silver halide in situ, for example, ammonium hexachlororhodinate (III), rhodium bromide, rhodium nitrate and potassium hexachlororhodinate (III); inorganic peroxides and persulfates such as ammonium peroxide disulfide and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidine and asym-triazines such as 2,4-dihydroxypyrimidine and 2-hydroxy-4-aminopyrimidine; azauracil and tetraazapentalene derivatives such as 3,6-dimercapto-1,4-diphenyl-1H,4H-2,3a,5,6a-tetraazapentalene, and 1,4-di(o-chlorophenyl)-3,6-dimercapto-1H,4H-2,3a,5,6a-tetraazapentalene.

The toner may be added in any desired form, for example, as a solution, powder and solid microparticulate dispersion. The solid microparticulate dispersion of the toner is prepared by well-known finely dividing means such as ball mills, vibratory ball mills, sand mills, colloid mills, jet mills, and roller mills. Dispersing aids may be used in preparing the solid microparticulate dispersion.

Binder The emulsion layer used herein is based on a binder. Exemplary binders are naturally occurring polymers and synthetic resins, for example, gelatin, polyvinyl acetal, polyvinyl chloride, polyvinyl acetate, cellulose acetate, polyolefins, polyesters, polystyrene, polyacrylonitrile, and polycarbonate. Of course, copolymers and terpolymers are included. Preferred polymers are polyvinyl butyral, butylethyl cellulose, methacrylate copolymers, maleic anhydride ester copolymers, polystyrene and butadiene-styrene copolymers. These polymers may be used alone or in admixture of two or more as desired. The polymer is used in such a range that it may effectively function as a binder to carry various components.

The binder used in the emulsion layer according to the invention may be a hydrophobic polymer dispersed in an aqueous solvent. The "aqueous" solvent is water or a mixture of water and less than 70% by weight of a water-miscible organic solvent. Examples of the water-miscible organic solvent include methanol, ethanol, propanol, ethyl acetate, dimethylformamide, methyl cellosolve, and butyl cellosolve. Exemplary solvent mixtures are a 90/10, 70/30 or 50/50 mixture of water/methyl alcohol, a 90/10 mixture of water/isopropyl alcohol, a 95/5 mixture of water/butyl cellosolve, a 95/5 mixture of water/dimethylformamide, and a 90/5/5 or 80/15/5 mixture of water/methyl alcohol/dimethylformamide, all expressed in a weight ratio.

The "dispersion" means that the polymer is not thermodynamically dissolved in a solvent, but dispersed in an aqueous solvent in a latex, micelle or molecular dispersion form. The polymer used as the binder should preferably have an equilibrium moisture content of up to 2% by weight at 25° C. and RH 60%. The lower limit of equilibrium moisture content is not critical although it is preferably 0.01% by weight, more preferably 0.03% by weight. The equilibrium moisture content (Weq) of a polymer at 25° C. and RH 60% is calculated according to the following expression:

$$Weq=(W1-W0)/W0\times 100\%$$

using the weight (W1) of the polymer conditioned in an atmosphere of 25° C. and RH 60% until equilibrium is reached and the weight (W0) of the polymer in an absolute dry condition.

The polymer used as the binder is not critical insofar as it is dispersible in the aqueous solvent. Included in the polymer are acrylic resins, polyester resins, polyurethane resins, vinyl chloride resins, vinylidene chloride resins, rubbery resins (e.g., SBR and NBR resins), vinyl acetate resins, polyolefin resins, and polyvinyl acetal resins. The polymer may be either a homopolymer or a copolymer having two or more monomers polymerized together. The polymer may be linear or branched or crosslinked. The polymer preferably has a number average molecule weight Mn of about 1,000 to about 1,000,000, more preferably about 3,000 to about 500,000. Polymers with a number average molecular weight of less than 1,000 would generally provide a low film strength after coating, resulting in a photosensitive material susceptible to crazing. A styrene-butadiene copolymer falling in the scope of the SBR resin is also a preferred binder.

The "styrene-butadiene copolymer" encompasses polymers containing styrene and butadiene in their molecular chain. The molar ratio of styrene to butadiene preferably ranges from 99/1 to 40/60. In addition to styrene and butadiene, the styrene-butadiene copolymer may have another vinyl monomer copolymerized therein, for example, acrylates and methacrylates such as methyl methacrylate and ethyl methacrylate, acid components such as acrylic acid, methacrylic acid, and itaconic acid, and acrylonitrile and divinyl benzene. The copolymer should permeably contain more than 50% by weight of styrene and butadiene combined.

Preferably the styrene-butadiene copolymer has a number average molecular weight of about 2,000 to 1,000,000, more preferably about 5,000 to 500,000.

In the practice of the invention, the styrene-butadiene copolymer is usually a random copolymer. The styrene-butadiene copolymer may be a linear, branched or crosslinked one. It is often used in the form of particles having a mean particle size of about 0.01 to 1 $\mu$m.

These polymers are commercially available. Useful commercial examples of the polymer include acrylic resins such as Sebian A-4635, 46583, and 4601 (Daicell Chemical K.K.) and Nipol LX811, 814, 820, 821 and 857 (Nippon Zeon K.K.), and polyester resins such as FINETEX ES650, 611, 679, 675, 525, 801, and 850 (Dai-Nihon Ink Chemical K.K.) and WD-size and WMS (Eastman Chemical Products, Inc.).

Preferred illustrative examples of the rubbery (SBR) resin and styrene-butadiene copolymer are given below as P-1 to P-5 wherein numerical values are % by weight and Mn is a number average molecular weight.

| Designation | Units | Mn |
|---|---|---|
| P-1 | $-(St)_{70}-(Bu)_{30}$-latex | 30,000 |
| P-2 | $-(St)_{60}-(Bu)_{37}-(MAA)_{3}$-latex | 45,000 |
| P-3 | $-(St)_{50}-(Bu)_{40}-(AN)_{7}-(AA)_{3}$-latex | 70,000 |
| P-4 | $-(St)_{70}-(Bu)_{20}-(DVB)_{5}-(MAA)_{5}$-latex | 100,000 |
| P-5 | $-(St)_{50}-(Bu)_{30}-(AN)_{15}-(IA)_{5}$-latex | 60,000 |

St: styrene

Bu: butadiene

MAA: methacrylic acid

AA: acrylonitrile

AA: acrylic acid

DVB: divinyl benzene

IA: itaconic acid

Other useful commercial examples of the copolymer include LACSTAR 3307B, DS-205, 602, DS203, 7132C, and DS807 (Dai-Nihon Ink Chemical K.K.), Nipol 2507, Lx4l6, Lx433, Lx410, Lx430, and Lx435 (Nippon Zeon K.K.), and DL-670, L-5702 and 1235 (Asahi Chemicals K.K.).

These copolymers may be used alone or in admixture of two or more as the binder.

In the preferred embodiment wherein a styrene-butadiene copolymer is used as the binder, the coating solution should preferably have a solid concentration of 0.5 to 12%, more preferably 1 to 8% by weight in the above-mentioned solvent.

The effective amount of the binder used may be properly determined by those skilled in the art without undue experimentation. Taken at least as a measure for carrying the organic silver salt in the film, the weight ratio of the binder to the organic silver salt is preferably in the range of from 15:1 to 1:3, more preferably from 8:1 to 1:2.

Hydrazine derivative

A hydrazine derivative may be used in the photothermographic material of the invention. The hydrazine derivative is selected from the compounds of formula (I) in Japanese Patent Application No. 47961/1994, more particularly compounds I-1 to 1-53 disclosed therein.

Other hydrazine derivatives are also useful. Included are the compounds of the chemical formula [1] in JP-B 77138/1994, more specifically the compounds described on pages 3 and 4 of the same; the compounds of the general formula (1) in JP-B 93082/1994, more specifically compound Nos. 1 to 38 described on pages 8 to 18 of the same; the compounds of the general formulae (4), (5) and (6) in JP-A 230497/1994, more specifically compounds 4-1 to 4-10 described on pages 25 and 26, compounds 5-1 to 5-42 described on pages 28 to 36, and compounds 6-1 to 6-7 described on pages 39 and 40 of the same; the compounds of the general formulae (1) and (2) in JP-A 289520/1994, more specifically compounds 1-1 to 1-17 and 2-1 described on pages 5 to 7 of the same; the compounds of the chemical formulae [2] and [3] in JP-A 313936/1994, more specifically 30 the compounds described on pages 6 to 19 of the same; the compounds of the chemical formula [1] in JP-A 313951/1994, more specifically the compounds described on pages 3 to 5 of the same; the compounds of the general formula (I) in JP-A 5610/1995, more specifically compounds 1-1 to 1-38 described on pages 5 to 10 of the same; the compounds of the general formula (II) in JP-A 77783/1995, more specifically compounds II-1 to II-102 described on pages 10 to 27 of the same; the compounds of the general formulae (H) and (Ha) in JP-A 104426/1995, more specifically compounds H-1 to H-44 described on pages 8 to 15 of the same; the compounds having an anionic group in proximity to a hydrazine group or a nonionic group forming an intermolecular hydrogen bond with the hydrogen atom of hydrazine in Japanese Patent Application No. 191007/1995, specifically the compounds of general formulae (A), (B), (C), (D), (E) and (F), more specifically compounds N-1 to N-30; and the compounds of the general formula (1) in Japanese Patent Application No. 191007/1995, more specifically compounds D-1 to D-55.

In the practice of the invention, the hydrazine nucleating agent may be used after it is dissolved in a suitable water-miscible organic solvent, for example, alcohols (e.g., methanol, ethanol, propanol and fluorinated alcohols), ketones (e.g., acetone and methyl ethyl ketone), dimethylformamide, dimethylsulfoxide, and methyl cellosolve.

Also, a well-known emulsifying dispersion method is used for dissolving the hydrazine nucleating agent with the aid of an oil such as dibutyl phthalate, tricresyl phosphate, glyceryl triacetate and diethyl phthalate or an auxiliary solvent such as ethyl acetate and cyclohexanone whereby an emulsified dispersion is mechanically prepared. Alternatively, a method known as a solid dispersion method is used for dispersing the hydrazine derivative in powder form in water in a ball mill, colloidal mill or ultrasonic mixer.

The hydrazine nucleating agent according to the invention may be added to a silver halide emulsion layer on a support or another hydrophilic colloid layer on the same side as the silver halide emulsion layer, preferably the silver halide emulsion layer or a hydrophilic colloid layer disposed adjacent thereto.

The hydrazine nucleating agent is preferably used in an amount of 1 $\mu$mol to 10 mmol, more preferably 10 $\mu$mol to 5 mmol, most preferably 20 $\mu$mol to 5 mmol per mol of silver halide.

Protective layer

A surface protective layer may be provided in the photosensitive material according to the present invention for the purpose of preventing adhesion of an image forming layer. The surface protective layer may be formed of any adhesion-preventing material. Examples of the adhesion-preventing material include wax, silica particles, styrene-containing elastomeric block copolymers (e.g., styrene-butadiene-styrene and styrene-isoprene-styrene), cellulose acetate, cellulose acetate butyrate, cellulose propionate and mixtures thereof.

In the emulsion layer or a protective layer therefor according to the invention, there may be used light absorbing substances and filter dyes as described in U.S. Pat. Nos. 3,253,921, 2,274,782, 2,527,583, and 2,956,879. The dyes may be mordanted as described in U.S. Pat. No. 3,282,699.

In the emulsion layer or a protective layer therefor according to the invention, there may be used matte agents, for example, starch, titanium dioxide, zinc oxide, and silica as well as polymer beads including beads of the type described in U.S. Pat. Nos. 2,992,101 and 2,701,245. The emulsion surface may have any degree of matte insofar as no star dust failures occur although a Bekk smoothness of 1,000 to 10,000 seconds, especially 2,000 to 10,000 seconds is preferred.

In the practice of the invention, the photothermographic emulsion is contained in one or more layers on a support.

In the event of one-layer construction, it should contain an organic silver salt, silver halide, reducing (or developing) agent, binder and other optional additives such as a toner, coating aid and other aids. In the event of two-layer construction, a first emulsion layer which is generally a layer disposed adjacent to the support should contain an organic silver salt and silver halide and a second emulsion layer or both the layers contain other components. Also contemplated herein is a two layer arrangement consisting of a single emulsion layer containing all the components and a protective top coat. In the case of multi-color sensitive photothermographic material, a combination of such two layers may be employed for each color. Also a single layer may contain all necessary components as described in U.S. Pat. No. 4,708,928. In the case of multi-dye, multi-color sensitive photothermographic material, emulsion (or photosensitive) layers are distinctly supported by providing a functional or non-functional barrier layer therebetween as described in U.S. Pat. No. 4,460,681.

In the practice of the invention, an antihalation layer may be disposed on the side of the photosensitive layer remote from a light source. The antihalation layer preferably exhibits a maximum absorbance of 0.3 to 2 in the desired wavelength range, more preferably an absorbance of 0.5 to 2 at the exposure wavelength and 0.001 to less than 0.5 in the visible range after processing. Further preferably, the antihalation layer has an optical density of 0.001 to less than 0.3.

Where antihalation dyestuffs are used in the practice of the invention, such a dyestuff may be any compound which has desired absorption in a wavelength range, exhibits sufficiently low absorption in the visible region after processing, and provides the antihalation layer with a preferred absorbance spectrum profile. Illustrative, non-limiting, examples of the antihalation dye include dyes which are effective alone, for example, the compounds described in JP-A 56458/1984, 216140/1990, 13295/1995, 11432/1995, U.S. Pat. No. 5,380,635, JP-A 68539/1990, page 13, lower-left column to page 14, lower-left column, and JP-A 24539/1991, page 14, lower-left column to page 16, lower-right column; and dyes which are bleached during processing, as disclosed in, for example, JP-A 139136/1977, 132334/1978, 501480/1981, 16060/1982, 68831/1982, 101835/1982, 182436/1984, 36145/1995, 199409/1995, JP-B 33692/1973, 16648/1975, 41734/1990, U.S. Pat. Nos. 4,088,497, 4,283,487, 4,548,896, and 5,187,049.

In one preferred embodiment, the photothermographic material of the invention is a one-side photosensitive material having at least one photosensitive (or emulsion) layer containing a silver halide emulsion on one side and a back (or backing) layer on the other side of the support.

In the practice of the invention, a matte agent may be added to the one-side photosensitive material for improving feed efficiency. The matte agents used herein are generally microparticulate water-insoluble organic or inorganic compounds. There may be used any desired one of matte agents, for example, well-known matte agents including organic matte agents as described in U.S. Pat. Nos. 1,939,213, 2,701,245, 2,322,037, 3,262,782, 3,539,344, and 3,767,448 and inorganic matte agents as described in U.S. Pat. Nos. 1,260,772, 2,192,241, 3,257,206, 3,370,951, 3,523,022, and 3,769,020. Illustrative examples of the organic compound which can be used as the matte agent are given below; exemplary water-dispersible vinyl polymers include polymethyl acrylate, polymethyl methacrylate, polyacrylonitrile, acrylonitrile-α-methylstyrene copolymers, polystyrene, styrene-divinylbenzene copolymers, polyvinyl acetate, polyethylene carbonate, and polytetrafluoroethylene; exemplary cellulose derivatives include methyl cellulose, cellulose acetate, and cellulose acetate propionate; exemplary starch derivatives include carboxystarch, carboxynitrophenyl starch, urea-formaldehyde-starch reaction products, gelatin hardened with well-known curing agents, and hardened gelatin which has been coaceruvation hardened into microcapsulated hollow particles. Preferred examples of the inorganic compound which can be used as the matte agent include silicon dioxide, titanium dioxide, magnesium dioxide, aluminum oxide, barium sulfate, calcium carbonate, silver chloride and silver bromide desensitized by a well-known method, glass, and diatomaceous earth. The aforementioned matte agents may be used as a mixture of substances of different types if necessary. The size and shape of the matte agent are not critical. The matte agent of any particle size may be used although matte agents having a particle size of 0.1 μm to 30 μm are preferably used in the practice of the invention. The particle size distribution of the matte agent may be either narrow or wide. Nevertheless, since the haze and surface luster of photosensitive material are largely affected by the matte agent, it is preferred to adjust the particle size, shape and particle size distribution of a matte agent as desired during preparation of the matte agent or by mixing plural matte agents.

In the practice of the invention, the back layer should preferably have a degree of matte as expressed by a Bekk smoothness of 10 to 250 seconds, more preferably 50 to 180 seconds.

In the photosensitive material of the invention, the matte agent is preferably contained in an outermost surface layer, a layer functioning as an outermost surface layer, a layer close to the outer surface or a layer functioning as a so-called protective layer.

In the practice of the invention, the binder used in the back layer is preferably transparent or translucent and generally colorless. Exemplary binders are naturally occurring polymers, synthetic resins, polymers and copolymers, and other film-forming media, for example, gelatin, gum arabic, poly(vinyl alcohol), hydroxyethyl cellulose, cellulose acetate, cellulose acetate butyrate, poly(vinyl pyrrolidone), casein, starch, poly(acrylic acid), poly(methyl methacrylate), polyvinyl chloride, poly(methacrylic acid), copoly(styrene-maleic anhydride), copoly(styrene-acrylonitrile), copoly(styrene-butadiene), polyvinyl acetals (e.g., polyvinyl formal and polyvinyl butyral), polyesters, polyurethanes, phenoxy resins, poly(vinylidene chloride), polyepoxides, polycarbonates, poly(vinyl acetate), cellulose esters, and polyamides. The binder may be dispersed in water, organic solvent or emulsion to form a dispersion which is coated to form a layer.

The back layer preferably exhibits a maximum absorbance of 0.3 to 2, more preferably 0.5 to 2 in the predetermined wavelength range and an absorbance of 0.001 to less than 0.5 in the visible range after processing. Further preferably, the back layer has an optical density of 0.001 to less than 0.3. Examples of the antihalation dye used in the back layer are the same as those used in the antihalation layer.

A backside resistive heating layer as described in U.S. Pat. Nos. 4,460,681 and 4,374,921 may be used in a thermographic imaging system according to the present invention.

According to the invention, a hardener may be used in various layers including a photosensitive layer, protective layer, and back layer. Examples of the hardener include polyisocyanates as described in U.S. Pat. No. 4,281,060 and JP-A 208193/1994, epoxy compounds as described in U.S. Pat. No. 4,791,042, and vinyl sulfones as described in JP-A 89048/1987.

A surfactant may be used for the purposes of improving coating and electric charging properties. The surfactants used herein may be nonionic, anionic, cationic and fluorinated ones. Examples include fluorinated polymer surfactants as described in JP-A 170950/1987 and U.S. Pat. No. 5,380,644, fluorinated surfactants as described in JP-A 244945/1985 and 188135/1988, polysiloxane surfactants as described in U.S. Pat. No. 3,885,965, and polyalkylene oxide and anionic surfactants as described in JP-A 301140/1994.

Examples of the solvent used herein are described in New Solvent Pocket Book, Ohm K.K., 1994, though not limited thereto. The solvent used herein should preferably have a boiling point of 40 to 180° C. Exemplary solvents include hexane, cyclohexane, toluene, methanol, ethanol, isopropanol, acetone, methyl ethyl ketone, ethyl acetate, 1,1,1-trichloroethane, tetrahydrofuran, triethylamine, thiphene, trifluoroethanol, perfluoropentane, xylene, n-butanol, phenol, methyl isobutyl ketone, cyclohexanone, butyl acetate, diethyl carbonate, chlorobenzene, dibutyl ether, anisole, ethylene glycol diethyl ether, N,N-dimethylformamide, morpholine, propanesultone, perfluorotributylamine, and water.

According to the invention, the photothermographic emulsion may be coated on a variety of supports. Typical supports include polyester film, subbed polyester film, poly (ethylene terephthalate) film, polyethylene naphthalate film, cellulose nitrate film, cellulose ester film, poly(vinyl acetal) film, polycarbonate film and related or resinous materials, as well as glass, paper, metals, etc. Often used are flexible substrates, typically paper supports, specifically baryta paper and paper supports coated with partially acetylated α-olefin polymers, especially polymers of α-olefins having 2 to 10 carbon atoms such as polyethylene, polypropylene, and ethylene-butene copolymers. The supports are either transparent or opaque, preferably transparent.

The photosensitive material of the invention may have an antistatic or electroconductive layer, for example, a layer containing soluble salts (e.g., chlorides and nitrates), an evaporated metal layer, or a layer containing ionic polymers as described in U.S. Pat. Nos. 2,861,056 and 3,206,312 or insoluble inorganic salts as described in U.S. Pat. No. 3,428,451.

A method for producing color images using the photothermographic material of the invention is as described in JP-A 13295/1995, page 10, left column, line 43 to page 11, left column, line 40. Stabilizers for color dye images are exemplified in UKP 1,326,889, U.S. Pat. Nos. 3,432,300, 3,698,909, 3,574,627, 3,573,050, 3,764,337, and 4,042,394.

In the practice of the invention, the photothermographic emulsion can be coated by various coating procedures including dip coating, air knife coating, flow coating, and extrusion coating using a hopper of the type described in U.S. Pat. No. 2,681,294. If desired, two or more layers may be concurrently coated by the methods described in U.S. Pat. No. 2,761,791 and UKP 837,095.

In the photothermographic material of the invention, there may be contained additional layers, for example, a dye accepting layer for accepting a mobile dye image, an opacifying layer when reflection printing is desired, a protective topcoat layer, and a primer layer well known in the photothermographic art. The photosensitive material of the invention is preferably such that only a single sheet of the photosensitive material can form an image. That is, it is preferred that a functional layer necessary to form an image such as an image receiving layer does not constitute a separate member.

The photosensitive material of the invention may be developed by any desired method although it is generally developed by heating after imagewise exposure. The preferred developing temperature is about 80 to 250° C., more preferably 100 to 140° C. and the preferred developing time is about 1 to 180 seconds, more preferably about 10 to 90 seconds.

Any desired technique may be used for the exposure of the photothermographic material of the invention. The preferred light source for exposure is a laser, for example, a gas laser, YAG laser, dye laser, and semiconductor laser. A semiconductor laser combined with a second harmonic generating device is also useful.

Upon exposure, the photosensitive material of the invention tends to generate interference fringes due to low haze. Known techniques for preventing generation of interference fringes are a technique of obliquely directing laser light to a photosensitive material as disclosed in JP-A 113548/1993 and the utilization of a multi-mode laser as disclosed in WO 95/31754. These techniques are preferably used herein.

Upon exposure of the photosensitive material of the invention, exposure is preferably made by overlapping laser light so that no scanning lines are visible, as disclosed in SPIE, Vol. 169, Laser Printing 116–128 (1979), JP-A 51043/1992, and WO 95/31754.

EXAMPLE

Examples of the present invention are given below by way of illustration and not by way of limitation.

The trade names used in Examples have the following meaning.

BUTVAR B-76: polyvinyl butyral by Monsanto Co.

Denka Butyral: polyvinyl butyral by Denki Kagaku Kogyo K.K.

CAB 171-15S and 381-20: cellulose acetate butyrate by Eastman Chemical Products, Inc.

Megafax F-176P: fluorinated surfactant by Dai-Nihon Ink Chemical Industry K.K.

Sildex: spherical silica by Dokai Chemical K.K.

Sumidur N3500: polyisocyanate by Sumitomo-Bayern Urethane K.K.

Example 1

Silver halide grains

In 700 ml of water were dissolved 22 grams of phthalated gelatin and 30 mg of potassium bromide. The solution was adjusted to pH 5.0 at a temperature of 35° C. To the solution, 159 ml of an aqueous solution containing 18.6 grams of silver nitrate and 0.9 gram of ammonium nitrate and an aqueous solution containing potassium bromide and potassium iodide in a molar ratio of 92:8 were added over 10 minutes by the controlled double jet method while maintaining the solution at pAg 7.7. Then, 476 ml of an aqueous solution containing 55.4 grams of silver nitrate and 2 grams of ammonium nitrate and an aqueous solution containing 8 μmol/liter of dipotassium hexachloroiridate and 1 mol/liter of potassium bromide were added over 30 minutes by the controlled double jet method while maintaining the solution at pAg 7.7. After 1 gram of 4-hydroxy-6-methyl-1,3,3a,7-tetraazaindene was added, the pH of the solution was lowered to cause flocculation and sedimentation for desalting. The solution was adjusted to pH 5.9 and pAg 8.2 by adding 0.1 gram of phenoxyethanol. There were obtained cubic grains of silver iodobromide having an iodide content of 8 mol % in the core and 2 mol % on the average, a mean grain size of 0.05 μm, a coefficient of variation of the projected area diameter of 8%, and a (100) face proportion of 90%.

The thus obtained silver halide grains were heated at 60° C., to which 85 μmol of sodium thiosulfate, 11 μmol of 2,3,4,5,6-pentafluorophenyldiphenylphosphine selenide, 15 μmol of Tellurium compound 1, and 2 μmol of chloroauric acid were added per mol of silver. The solution was ripened for 90 minutes and then quenched to 30° C., completing the preparation of a silver halide emulsion.

Organic acid silver emulsion

While a mixture of 7 grams of stearic acid, 4 gram of arachidic acid, 36 grams of behenic acid, and 850 ml of distilled water was vigorously stirred at 90° C., 187 ml of 1N NaOH aqueous solution was added. Reaction was carried out for 60 minutes. After 65 ml of 1N nitric acid was added, the solution was cooled to 500C. With more vigorous stirring, 0.6 g of N-bromosuccinimide was added to the solution and after 10 minutes, the above-prepared silver halide emulsion was added in such an amount as to give 6.2 mmol of silver halide. Further, 125 ml of an aqueous solution containing 21 grams of silver nitrate was added over 100 seconds and stirring was continued for 10 minutes. 0.6 g of N-bromosuccinimide was added to the solution, which was allowed to stand for 10 minutes. Thereafter, the solids were separated by suction filtration and washed with water until the water filtrate reached a conductivity of 30 μS/cm. To the thus obtained organic acid silver solids was added 150 grams of a 0.6 wt % butyl acetate solution of polyvinyl acetate, followed by agitation. Agitation was stopped and the reaction mixture was allowed to stand whereupon it separated into an oil layer and an aqueous layer. The aqueous layer was removed together with salts contained therein. To the oil layer was added 80 grams of a 2.5 wt % 2-butanone solution of polyvinyl butyral (Denka Butyral #3000-K), followed by agitation. Then 0.1 mmol of pyridinium bromide perbromide and 0.15 mmol of calcium bromide dihydrate were added thereto together with 0.7 gram of methanol, and 200 grams of 2-butanone and 59 grams of polyvinyl butyral (BUTVAR B-76) were further added. The mixture was dispersed by means of a homogenizer, obtaining an organic acid silver salt emulsion of needle grains having a mean minor diameter of 0.04 μm, a mean major diameter of 1 μm and a coefficient of variation of 30%.

Emulsion layer coating solution

Various chemicals were added to the above-prepared organic acid silver salt emulsion in amounts per mol of silver. With stirring at 25° C., 10 mg of sodium phenylthiosulfonate, 0.2 mmol of a dye as shown in Table 1, an amount of a compound of formula (I) as shown in Table 1, 21.5 grams of 4-chlorobenzophenone-2-carboxylic acid, 580 grams of 2-butanone, and 220 grams of dimethylformamide were added to the emulsion, which was allowed to stand for 3 hours. With stirring, there were further added 8 grams of 5-tribromomethylsulfonyl-2-methylthiadiazole, 6 grams of 2-tribromomethylsulfonylbenzothiazole, 5 grams of 4,6-ditrichloromethyl-2-phenyltriazine, 2 grams of Disulfide compound 1, 150 grams of 1,1-bis(2-hydroxy-3,5-dimethylphenyl)-3,5,5-trimethylhexane, an amount of Dyestuff III-14 to give a density of a coating at 820 nm as shown in Table 1, 1.1 grams of Megafax F-176P surfactant, 590 grams of 2-butanone, and 10 grams of methyl isobutyl ketone.

Emulsion surface protective layer coating solution

A coating solution was prepared by dissolving 75 grams of CAB 171-15S cellulose acetate butyrate, 5.9 grams of 4-methylphthalic acid, 1.5 grams of tetrachlorophthalic anhydride, 12 grams of phthalazine, 5.1 grams of tetrachlorophthalic acid, 0.3 gram of Megafax F-176P surfactant, 2 grams of Sildex H31 spherical silica (mean particle size 3 μm), and 6 grams of Sumidur N3500 polyisocyanate in 3,070 grams of 2-butanone and 30 grams of ethyl acetate.

Back layer coating solution

Calcium compound 1 was synthesized by adding 167 ml of an aqueous solution containing 0.019 mol of calcium chloride and 125 ml of 25% aqueous ammonia to 1 liter of an ethanol solution containing 0.08 mol of 3,5-di-tert-butylcatechol, and blowing air into the solution for 3 hours at room temperature. There were precipitated crystals of bis[2-(3,5-di-tert-butyl-o-benzoquinonemonoimine)-4,6-di-tert-butylphenolato]calcium (II).

A back layer coating solution was prepared by adding 12 grams of Denka Butyral #4000-2 polyvinyl butyral, 12 grams of CAB 381-20 cellulose acetate butyrate, 120 mg of Dyestuff 1, 290 mg of Calcium compound 1, 340 mg of Dyestuff 2, 5 mg of Dyestuff 3, 0.4 gram of Sildex H121 spherical silica (mean particle size 12 μm), 0.4 gram of Sildex H51 spherical 15 silica (mean particle size 5 μm), 2 grams of X-22-2809 silicone compound (by Shin-Etsu Silicone K.K.), 0.1 gram of Megafax F-176P surfactant, and 2 grams of Sumidur N3500 polyisocyanate to 500 grams of ethyl acetate and 500 grams of 2-propanol and stirring the mixture for dissolving the components.

Coated sample

Onto one surface of a 175-μm thick polyethylene terephthalate support tinted with a blue dyestuff, the emulsion layer coating solution prepared above was coated so as to provide a coverage of 2,3 g/m$^2$ of silver. The back layer coating solution was then coated on the opposite surface of the support so as to provide an optical density of 0.7 at 810 nm. Further, the emulsion surface protective layer coating solution was coated onto the emulsion layer to a dry thickness of 2 μm. A series of photosensitive materials were obtained in this way (Nos. 1 to 12, see Table 1).

The photosensitive materials had a surface smoothness corresponding to a Bekk smoothness of 1,000 seconds on the emulsion side and 80 seconds on the back surface as measured by the Oken type smoothness measurement described in J. TAPPI, Paper Pulp Test No. 5.

Tellurium compound 1, Disulfide compound 1, Comparative dye 1 (CD1), Dyestuff III-14, Dyestuffs 1, 2 and 3, and blue dyestuff have the structures shown below.

Tellurium compound 1

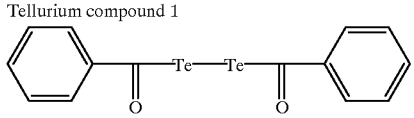

Disulfide compound 1

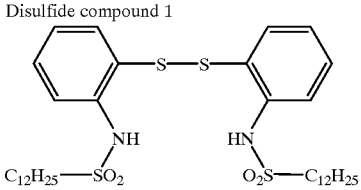

Comparative dye 1

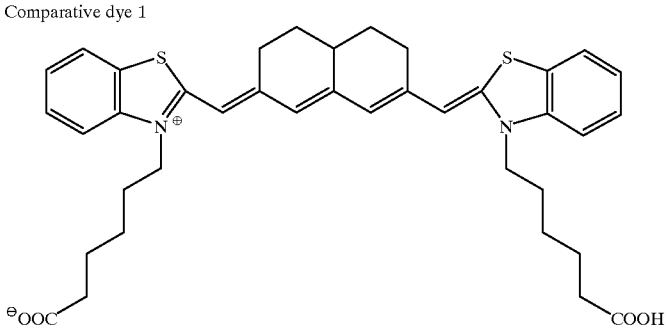

-continued
Dyestuff III-14
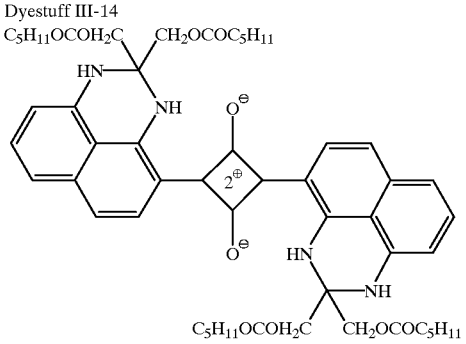
Dyestuff 1
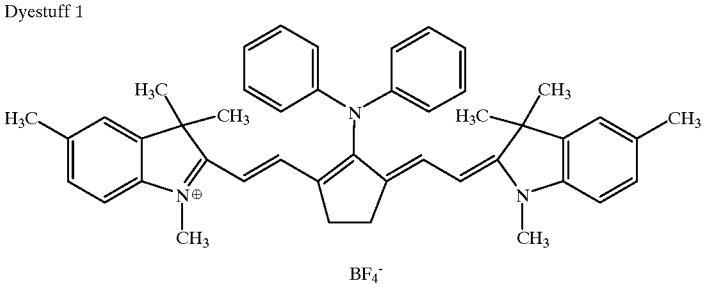
Dyestuff 2
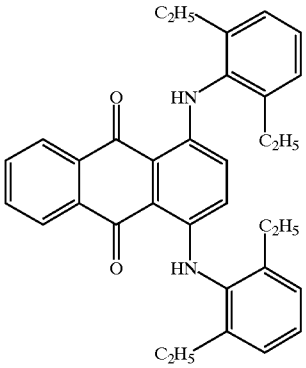
Dyestuff 3
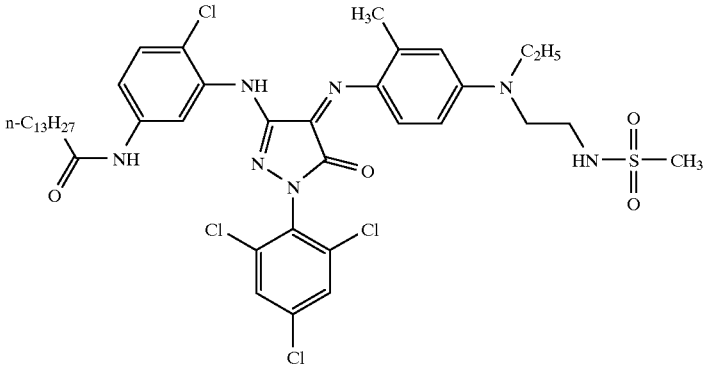

-continued

Blue Dyestuff

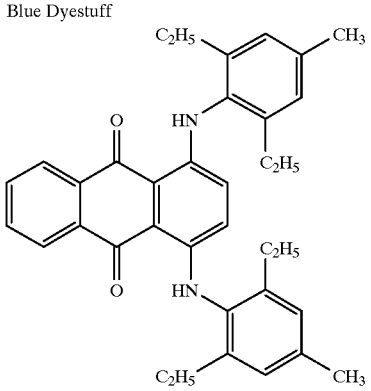

The coated samples were examined by the following tests.

Absorbance of emulsion layer

The photosensitive material with its back layer removed was placed at the cell mount position of a spectrophotometer U-3410 (Hitachi K.K.) such that the photosensitive emulsion layer faced the light source and was extended perpendicular to the incident light. The absorbance at an exposure wavelength of 820 nm was measured and the absorbance of the support as a reference was subtracted from the measurement result. The light transmitted by the photosensitive material was captured by an integrating sphere (window area 20 mm×15 mm) located about 12 cm apart therefrom and then collected by a photomultiplier.

Photographic test

The photosensitive material was exposed to light by means of a laser sensitometer equipped with a 820-nm diode and developed by heating at 120° C. for 15 seconds. The resulting image was measured for Dmin and sensitivity by means of a densitometer. The sensitivity is the reciprocal of a ratio of the exposure providing a density of Dmin+1.0, and is expressed in a relative value based on a sensitivity of 100 for photosensitive material No. 1 before forced aging. The results are shown in Table 1.

Age stability test

Each photosensitive material was cut into sections of 30.5 cm×25.4 cm with round corners having an inner radius of 0.5 cm. Film sections were kept in an atmosphere of 25° C. and RH 50% for one day. Ten sheets of each sample were placed in a moisture-proof bag, which was sealed and placed in a decorative box of 35.1 cm×26.9 cm×3.0 cm. In this condition, the sheets were aged for 5 days at 50° C. (forced aging test). For comparison purposes, sample sheets were subject to the same aging test except that the storage temperature was 4° C. These aged sheets were processed as in the photographic test and measured for sensitivity. The sensitivity (S) is expressed in a relative value based on a sensitivity of 100 for photosensitive material No. 1.

Acutance test

A 1 cm×1 cm square surface area of the coated sample was exposed to light from a laser equipped with a 820-nm diode at an incident angle of 30°. Provided that X is an exposure giving a density of 2.5 and Y is an exposure giving a density of 0.5, rectangular zones having a short side of 100 μm and a long side of 1 cm arranged such that they adjoined each other along the long side were alternately exposed to the exposures X and Y. This region was measured for maximum density and minimum density by means of a microdensitometer. Acutance is the difference between the maximum density and the minimum density divided by 2. A higher acutance value suggests better sharpness.

The results are shown in Table 1.

TABLE

| Photosensitive | | Compound of formula (I) | | Absorbance | | Sensitivity | | |
|---|---|---|---|---|---|---|---|---|
| material | Dye | Type | Amount | @820 nm | Fog | Sensitivity | after aging | Acutance |
| 1** | CD1 | I-113 | 10 mmol | 0.1 | 0.18 | 100 | 40 | 0.30 |
| 2** | CD1 | I-113 | 10 mmol | 0.3 | 0.25 | 60 | 10 | 0.80 |
| 3** | II-9 | I-113 | 10 mmol | 0.1 | 0.17 | 300 | 280 | 0.20 |
| 4* | II-9 | I-113 | 10 mmol | 0.2 | 0.18 | 280 | 260 | 0.90 |
| 5* | II-9 | I-113 | 10 mmol | 0.3 | 0.18 | 240 | 240 | 0.95 |
| 6* | II-9 | I-113 | 10 mmol | 0.5 | 0.20 | 200 | 200 | 0.96 |
| 7* | II-1 | I-113 | 10 mmol | 0.3 | 0.18 | 220 | 200 | 0.94 |
| 8* | II-5 | I-113 | 10 mmol | 0.3 | 0.18 | 200 | 220 | 0.96 |
| 9* | II-9 | I-38 | 4 mmol | 0.3 | 0.18 | 150 | 120 | 0.92 |
| 10* | II-9 | I-113 | 4 mmol | 0.3 | 0.19 | 180 | 150 | 0.90 |
| 11* | II-9 | I-113 | 80 mmol | 0.3 | 0.19 | 200 | 220 | 0.91 |
| 12** | II-9 | — | — | 0.3 | 0.25 | 90 | 10 | 0.78 |

*invention

**comparison

It is evident from Table 1 that photosensitive materials within the scope of the invention exhibit sharpness, good aging stability, high sensitivity, and low fog.

Example 2

Emulsion layer coating solution

Various chemicals were added to the organic acid silver salt emulsion prepared in Example 1 in amounts per mol of silver. With stirring at 25° C., 10 mg of sodium phenylthiosulfonate, 0.2 mmol of a dye as shown in Table 2, an amount of a compound of formula (I) as shown in Table 2, 21.5 grams of 4-chlorobenzophenone-2-carboxylic acid, 580 grams of 2-butanone, and 220 grams of dimethylformamide were added to the emulsion. With stirring, there were further added 8 grams of 5-tribromomethylsulfonyl-2-methylthiadiazole, 6 grams of 2-tribromomethylsulfonylbenzothiazole, 3 grams of 4,6-ditrichloromethyl-2-phenyltriazine, 2 grams of Disulfide compound 1, 140 grams of 1,1-bis(2-hydroxy-3,5-dimethylphenyl)-3,5,5-trimethylhexane, an amount of Dyestuff 2 to give a density of a coating at 647 nm as shown in-Table 2, 50 mg of Dyestuff 3, 1.1 grams of Megafax F-176P surfactant, 590 grams of 2-butanone, and 10 grams of methyl isobutyl ketone.

Emulsion surface protective layer coating solution

It was prepared as in Example 1.

Back layer coating solution

Using a 1/16G sand grinder mill (Imex K.K.), 12 grams of tricyclohexylguanidine which was a solid base was dispersed in 1.6 grams of polyvinyl alcohol and 27 grams of water to form a base solution.

An organic solvent phase was prepared by mixing and dissolving 2 grams of a basic dye precursor, 2 grams of an acidic substance, 18 grams of a 3:1 addition product of xylylene diisocyanate and trimethylol propane, 24 grams of dibutyl phthalate, 20 mg of Dyestuff 2, and 5 grams of ethyl acetate. The organic solvent phase was mixed with an aqueous phase consisting of 5.2 grams of polyvinyl alcohol and 58 grams of water. The mixture was dispersed at room temperature into an emulsion having a mean particle size of 2.5 μm. The emulsion was combined with 100 grams of water, heated at 60° C. with stirring, and allowed to stand for 2 hours, obtaining a colored microcapsule solution.

A back layer coating solution was prepared by mixing 20 grams of the base solution prepared above, 20 grams of the colored microcapsule solution prepared above, 21 grams of gelatin, 0.8 gram of sodium dodecylbenzenesulfonate, and 0.6 gram of 1,3-divinylsulfon-2-propanol.

A back surface protective layer coating solution was prepared by dissolving 10 grams of gelatin, 0.6 gram of polymethyl methacrylate (mean particle size 7 μm), 0.4 gram of sodium dodecylbenzenesulfonate, and 0.2 gram of X-22-2809 silicone compound (Shin-Etsu Silicone K.K.) in 500 grams of water.

Photothermographic material

A 175-μm thick polyethylene terephthalate support had a moisture-proof undercoat of vinylidene chloride on one surface and a gelatin undercoat on the other surface. The emulsion layer coating solution was coated on the vinylidene chloride undercoat so as to give a silver coverage of 2.3 g/m$^2$. On the surface opposite to the emulsion layer, the back layer coating solution in such an amount to give an optical density of 0.5 at 650 nm and the back surface protective layer coating solution in such a flow rate to give a dry thickness of 0.9 μm were simultaneously coated in an overlapping manner. Further, the emulsion surface protective layer coating solution was coated on the emulsion layer so as to give a dry thickness of 2 μm. A series of photosensitive materials were obtained in this way (Nos. 13 to 18).

The sample was measured for surface smoothness or Bekk smoothness by the Oken type smoothness measurement described in J. TAPPI, Paper Pulp Test No. 5. The sample had a Bekk smoothness of 1,000 seconds on the emulsion side surface and 80 seconds on the back side surface. The amount of residual solvent on the emulsion layer coated surface of the coated sample was measured by gas chromatography, detecting 40 to 200 ppm of 2-butanone and 40 to 120 ppm of butyl acetate based on the weight of the coatings.

It is noted that Comparative dye 2 (CD2), Basic dye precursor, and Acidic substance have the structures shown below while the remaining compounds are as shown in Example 1.

Comparative dye 2

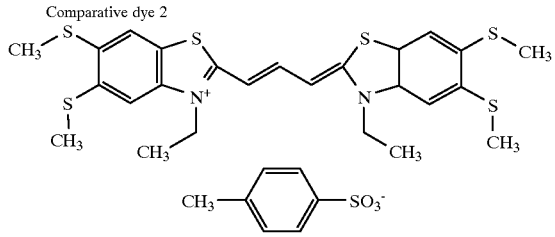

Basic dye precursor

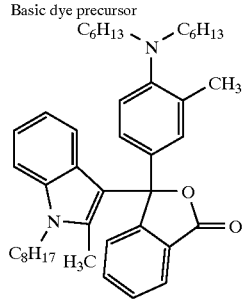

Acidic substance

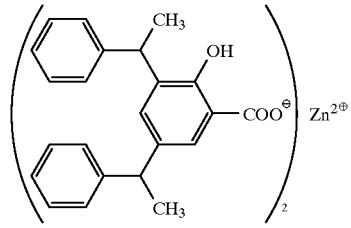

The coated samples were examined by the same tests as in Example 1 except that the photosensitive material was exposed to light from a 647-nm Kr laser sensitometer (maximum power 500 mW) at an incident angle of 30°, and the photosensitive material No. 13 before forced aging was used as the standard for sensitivity rating.

The results are shown in Table 2.

TABLE 2

| Photosensitive material | Dye | Compound of formula (I) Type | Amount | Absorbance @647 nm | Fog | Sensitivity | Sensitivity after aging | Acutance |
|---|---|---|---|---|---|---|---|---|
| 13** | CD2 | I-113 | 10 mmol | 0.3 | 0.18 | 100 | 5 | 0.85 |
| 14* | II-14 | I-113 | 10 mmol | 0.3 | 0.17 | 350 | 320 | 0.92 |
| 15* | II-15 | I-113 | 10 mmol | 0.3 | 0.17 | 300 | 300 | 0.95 |
| 16* | II-16 | I-113 | 10 mmol | 0.3 | 0.17 | 320 | 300 | 0.94 |
| 17* | II-18 | I-113 | 10 mmol | 0.3 | 0.17 | 350 | 350 | 0.95 |
| 18* | II-18 | — | — | 0.3 | 0.22 | 80 | 20 | 0.71 |

*invention
**comparison

It is evident from Table 2 that photosensitive materials within the scope of the invention exhibit sharpness, good aging stability, high sensitivity, and low fog.

Example 3

Photosensitive material Nos. 19, 20, and 21 were prepared by adding 1.5 mmol per mol of silver of 1-(2-methoxyphenyl)-2-formylhydrazide to photosensitive material Nos. 1, 2, and 5 of Example 1, respectively. Nos. 19 and 20 are outside and No. 21 is within the scope of the invention. The coated samples were measured for sensitivity, fog, and acutance by the same tests as in Example 1 except that the developing temperature was 115° C. A gradation was determined as the gradient between a density 0.3 and a density 3.0. The emulsion layer was measured for absorbance. The photosensitive material No. 19 was used as the standard for sensitivity rating.

The results are shown in Table 3.

TABLE 3

| Photosensitive material | Dye | Compound of formula (I) Type | Amount | Absorbance @820 nm | Fog | Sensitivity | Sensitivity after aging | Acutance |
|---|---|---|---|---|---|---|---|---|
| 19** | CD1 | I-113 | 10 mmol | 0.1 | 0.16 | 100 | 9 | 0.25 |
| 20** | CD1 | I-113 | 10 mmol | 0.3 | 0.17 | 50 | 8 | 0.70 |
| 21* | II-9 | I-113 | 10 mmol | 0.3 | 0.16 | 200 | 12 | 0.98 |

*invention
**comparison

It is evident from Table 3 that photosensitive materials within the scope of the invention exhibit high contrast, high sensitivity, low fog, and sharpness.

Example 4

Microcrystalline dispersion of organic acid silver

To 34.8 g calculated as dry solids of the organic acid silver emulsion prepared in Example 1 were added 12 grams of polyvinyl alcohol and 150 ml of water. They were thoroughly mixed to form a slurry. A vessel was charged with the slurry together with 840 grams of zirconia beads having a mean diameter of 0.5 mm. A dispersing machine (1/4G Sand Grinder Mill by Imex K.K.) was operated for 5 hours for dispersion, completing the preparation of a microcrystalline dispersion of organic acid silver needle grains having a mean minor diameter of 0.04 $\mu$m, a mean major diameter of 0.6 $\mu$m and a coefficient of variation of the projected area of 29% as measured by electron microscope observation.

Solid particle dispersions of chemical addenda

A mixed solid particle dispersion was prepared by mixing 5 grams of tetrachlorophthalic acid, 7 grams of 4-methylphthalic acid, 98 grams of 1,1-bis(2-hydroxy-3,5-dimethylphenyl)-3,5,5-trimethylhexane, 9.2 grams of phthalazine, and 12 grams of tribromomethylphenylsulfone, and a sufficient amount of Dyestuff 2 (see Example 1) to form a coating with a density of 0.3.

The addenda were mixed in powder form and combined with 0.81 grams of hydroxypropylmethyl cellulose and 942 ml of water. They were thoroughly agitated to form a slurry, which was allowed to stand for 10 hours. A vessel was charged with the slurry together with 100 ml of zirconia beads having a mean diameter of 0.5 mm. A dispersing machine as above was operated for 5 hours for dispersion, obtaining a solid particle dispersion (a) of chemical addenda in which particles with a diameter of 1.0 $\mu$m or less accounted for 70% by weight.

A solid particle dispersion (b) of chemical addenda was prepared by the same procedure as above except that Dyestuff 2 was added in an amount to form a coating with a density of 0.1.

Emulsion layer coating solution

An emulsion layer coating solution was prepared by adding to the microcrystalline dispersion of organic acid silver prepared above, 0.2 mmol of a dye as shown in Table 4, an amount of a compound of formula (I) as shown in Table 4, 430 grams of Lacstar 3307B SBR latex, and 1,000 ml of the solid particle dispersion of chemical addenda in the combination shown in Table 4, the amounts being expressed per mol of silver. Note that Lacstar 3307B is a styrene-butadiene copolymer latex whose dispersed particles have a mean particle size of 0.1 to 0.15 $\mu$m, commercially available from Dai-Nihon Ink Chemical Industry K.K.

Emulsion surface protective layer coating solution

A protective layer coating solution was prepared by mixing 10 grams of inert gelatin with 0.26 gram of $C_8F_{17}SO_2N(C_3H_7)CH_2COOK$, 0.09 gram of sodium dodecylbenzenesulfonate, 0.9 gram of silica particles with a mean particle size of 2.5 $\mu$m, 0.3 gram of 1,2-bisvinylsulfonylacetamide ethane, and 64 grams of water.

Photosensitive material

Photosensitive materials (Nos. 22 to 30) were prepared by coating the back layer coating solution of Example 1 to a non-tinted polyethylene terephthalate support of 175 μm thick, simultaneously coating the emulsion layer coating solution and the emulsion surface protective layer coating solution in an overlapping manner.

The photosensitive materials were tested as in Example 2. The photosensitive material No. 22 before forced aging was used as the standard for sensitivity rating.

The results are shown in Table 4.

TABLE 4

| Photosensitive | | Compound of formula (I) | | Absorbance | | Sensitivity | | |
|---|---|---|---|---|---|---|---|---|
| material | Dye | Type | Amount | @647 nm | Fog | Sensitivity | after aging | Acutance |
| 22** | CD2 | I-113 | 10 mmol | 0.1**** | 0.21 | 100 | 50 | 0.32 |
| 23** | CD2 | I-113 | 10 mmol | 0.3*** | 0.24 | 70 | 10 | 0.80 |
| 24** | II-15 | I-113 | 10 mmol | 0.1**** | 0.18 | 220 | 160 | 0.25 |
| 25** | II-15 | — | — | 0.3*** | 0.25 | 50 | 5 | 0.75 |
| 26* | II-15 | I-113 | 4 mmol | 0.3*** | 0.20 | 180 | 160 | 0.92 |
| 27* | II-15 | I-113 | 10 mmol | 0.3*** | 0.19 | 200 | 220 | 0.95 |
| 28* | II-15 | I-113 | 80 mmol | 0.3*** | 0.21 | 180 | 180 | 0.93 |
| 29* | II-16 | I-113 | 10 mmol | 0.3*** | 0.20 | 220 | 200 | 0.94 |
| 30* | II-18 | I-113 | 10 mmol | 0.3*** | 0.19 | 200 | 180 | 0.96 |

*invention
**comparison
***a solid particle dispersion (a) of chemical addenda
****a solid particle dispersion (b) of chemical addenda It is evident from Table 4 that photosensitive materials within the scope of the invention exhibit sharpness, good aging stability, high sensitivity, and low fog.

There has been described a photothermographic material comprising a sensitizing dye of formula (II) in combination with a compound of formula (I) whereby sharpness, sensitivity, and aging stability are improved.

Reasonable modifications and variations are possible from the foregoing disclosure without departing from either the spirit or scope of the present invention as defined by the claims.

We claim:

1. A photothermographic material comprising a binder, an organic silver salt, a reducing agent for silver ion, and photosensitive silver halide grains on at least one surface of a support, wherein a photosensitive layer containing the photosensitive silver halide grains further contains a compound of the formula (I) and a compound of the formula (II), and said photosensitive layer has an absorbance of 0.15 to 1.0 at an exposure wavelength, $$R—S(M)_n \quad (I)$$

wherein R is an aliphatic hydrocarbon, aryl or heterocyclic group, M is a hydrogen atom or cation, and letter n is a number determined so as to render the molecule neutral, (II)

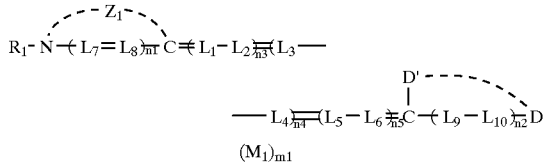

wherein $Z_1$ is a group of atoms necessary to form a 5- or 6-membered nitrogenous heterocycle, each of D and D' is a group of atoms necessary to form an acyclic or cyclic acidic nucleus, $R_1$ is an alkyl group, $L_1$, $L_2$, $L_3$, $L_4$, $L_5$, $L_6$, $L_7$, $L_8$, $L_9$, and $L_{10}$ each are a methine group, which may form a ring with another methine group or a ring with an auxochrome, letters n1, n2, n3, n4, and n5 each are equal to 0 or 1, $M_1$ is an electric charge neutralizing counter ion, and letter m1 is an integer inclusive of 0 necessary to neutralize an electric charge in a molecule.

2. The photothermographic material of claim 1 wherein the photosensitive layer contains 10 to 1,000 mol of the compound of formula (I) per mol of the compound of formula (II).

3. The photothermographic material of claim 1 wherein R in formula (I) is a nitrogenous heterocyclic group.

4. The photothermographic material of claim 1 wherein the compound of formula (I) is of the following formula (I-a):

(I-a)

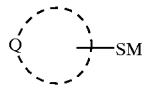

wherein M is as defined in formula (I) and Q is a group of atoms necessary to form a nitrogenous aromatic heterocycle.

5. The photothermographic material of claim 4 wherein the nitrogenous aromatic heterocycle formed by Q is a benzimidazole, benzoxazole or benzothiazole ring.

6. The photothermographic material of claim 1 wherein the compound of formula (II) is contained in an amount of $10^{-6}$ to 1 mol per mol of the silver halide.

7. The photothermographic material of claim 1 wherein said photosensitive layer exhibits an absorbance of 0.2 to 0.5 at the exposure wavelength.

8. The photosensitive material of claim 1, wherein $Z_1$ is benzothiazole, napthothiazole, benzoxazole, naphthoxazole, or benzimidazole.

9. The photosensitive material of claim 1, wherein said photosensitive material further contains a dyestuff.

10. The photosensitive material of claim 1, wherein the compound of formula (I) is added in an amount of from 20 to 400 mol per mol of the compound of formula (II).

11. The photosensitive material of claim 9, wherein the dyestuff is present in an amount of from 1 μg to 1 g per square meter of the photosensitive material.

* * * * *